US007196042B2

(12) United States Patent
Nakatani et al.

(10) Patent No.: US 7,196,042 B2
(45) Date of Patent: Mar. 27, 2007

(54) GREASE COMPOSITION AND ROLLING APPARATUS

(75) Inventors: Shinya Nakatani, Fujisawa (JP); Yasunobu Fujita, Fujisawa (JP); Michita Hokao, Fujisawa (JP); Hirotoshi Miyajima, Fujisawa (JP)

(73) Assignee: NSK Ltd., Tokyo (JP)

( * ) Notice: Subject to any disclaimer, the term of this patent is extended or adjusted under 35 U.S.C. 154(b) by 304 days.

(21) Appl. No.: 10/378,060

(22) Filed: Mar. 4, 2003

(65) Prior Publication Data

US 2004/0186025 A1 Sep. 23, 2004

(30) Foreign Application Priority Data

Mar. 7, 2002 (JP) ..... 2002-062069
Mar. 15, 2002 (JP) ..... 2002-073110
Aug. 30, 2002 (JP) ..... 2002-252665
Sep. 30, 2002 (JP) ..... 2002-286026

(51) Int. Cl.
*C10M 123/00* (2006.01)
*C10M 169/02* (2006.01)

(52) U.S. Cl. ..... 508/391; 508/181; 508/182; 508/582; 508/590; 384/13

(58) Field of Classification Search ..... 508/582, 508/181–182, 391
See application file for complete search history.

(56) References Cited

U.S. PATENT DOCUMENTS 4,324,673 A * 4/1982 Christian et al. ..... 508/182
4,941,987 A 7/1990 Strepparola et al. ..... 508/582
4,985,161 A * 1/1991 Tohzuka et al. ..... 508/182
5,494,596 A * 2/1996 Law et al. ..... 508/579
5,927,865 A * 7/1999 Ito et al. ..... 384/492
5,948,737 A 9/1999 Srinivasan et al. ..... 508/182
6,025,307 A * 2/2000 Chittofrati et al. ..... 508/182

(Continued)

FOREIGN PATENT DOCUMENTS

JP 57003897 1/1982

(Continued)

OTHER PUBLICATIONS

"Lubrication Control Manual Book" edited by the Japan Lubricating Oil Society and the Lubrication DiffusionTask Force, published Mar. 20, 1990.

*Primary Examiner*—Ellen M. McAvoy
(74) *Attorney, Agent, or Firm*—Crowell & Moring LLP

(57) ABSTRACT

A grease composition is produced by mixing a thickener comprising a fluoro resin and a second thickener component (a metallic soap, a complex metallic soap, an N-substituted terephthalamic acid metal salt, organic bentonite or a calcium sulfonate complex) into a base oil. This grease composition is excellent in heat resistance, load carring capacity, water resistance, rust protection, lubricating life and the like. A rolling apparatus filled with the above grease composition has excellent lubricating ability and is long-lived under high-temperature conditions. Moreover, a grease composition is produced by mixing a thickener comprising a fluoro resin and carbon black as a second thickener component into a base oil. This grease composition is excellent in heat resistance, water resistance, rust protection, lubricating life, electric conductivity and the like. A rolling apparatus filled with the above grease composition has excellent electric conductivity and is long-lived under high-temperature conditions.

5 Claims, 10 Drawing Sheets

U.S. PATENT DOCUMENTS

| | | | | |
|---|---|---|---|---|
| 6,086,686 | A * | 7/2000 | Tanaka et al. | 148/325 |
| 6,265,362 | B1 * | 7/2001 | Loderer et al. | 508/485 |
| 6,329,326 | B1 * | 12/2001 | Iso et al. | 508/182 |
| 6,432,887 | B1 * | 8/2002 | Yamamoto et al. | 508/138 |
| 6,444,621 | B1 | 9/2002 | Okaniwa et al. | 508/168 |
| 6,528,457 | B2 * | 3/2003 | Howell et al. | 508/180 |
| 6,548,454 | B1 * | 4/2003 | Yamamoto et al. | 508/138 |
| 6,589,918 | B2 * | 7/2003 | Denpo et al. | 508/100 |
| 6,723,684 | B2 * | 4/2004 | Akiyama et al. | 508/182 |
| 6,869,222 | B1 * | 3/2005 | Okita et al. | 384/462 |
| 6,919,301 | B2 * | 7/2005 | Nakatani et al. | 508/391 |

FOREIGN PATENT DOCUMENTS

| | | |
|---|---|---|
| JP | 61185599 | 8/1986 |
| JP | 02158692 | 6/1990 |
| JP | 04236298 | 8/1992 |
| JP | 06200273 | 7/1994 |
| JP | 07268370 | 10/1995 |
| JP | 09217745 | 8/1997 |
| JP | 11072120 | 3/1999 |
| JP | 11181465 | 7/1999 |
| JP | 2000109874 | 4/2000 |
| JP | 2001003074 | 1/2001 |
| JP | 2001187892 | 7/2001 |
| JP | 2001335792 | 12/2001 |

* cited by examiner

GREASE COMPOSITION AND ROLLING APPARATUS

BACKGROUND OF THE INVENTION

1. Field of the Invention

The present invention relates to a grease composition, which hardly disperses and has excellent high-temperature performance. Moreover, the present invention relates to a rolling apparatus, which has low torque and excellent acoustic performance and generates a few dusts, and in particular, the present invention relates to a rolling apparatus, which is preferably used in electronic intelligence equipment, semiconductor manufacturing machines and others.

Furthermore, the present invention relates to a grease composition having excellent lubricating ability and heat resistance. Still further, the present invention relates to a rolling apparatus, which has excellent lubricating ability and is long-lived under high-temperature conditions, and in particular, it relates to a rolling apparatus, which is preferably used as a rolling or sliding portion of machines used under high-temperature and high-speed conditions including car electrical components such as alternators or electromagnetic clutches; auxiliary equipment for car engine such as idler pulleys; and business machines such as copying machines or printers.

Furthermore, the present invention relates to a grease composition having excellent rust protection, extreme-pressure property, water resistance and lubricating life, and a rolling apparatus which is long-lived although it is used under stringent conditions.

Furthermore, the present invention relates to a grease composition having excellent heat resistance, lubricating ability and rust protection. Still further, the present invention relates to a rolling apparatus which has excellent lubricating ability and is long-lived under high-temperature conditions, and it particularly relates to a rolling bearing, which is preferably used in electrical machines for a car engine which are required for heat resistance, load carring capacity and durability.

Furthermore, the present invention relates to a grease composition having excellent lubricating ability and electric conductivity. Still further, the present invention relates to a rolling apparatus, which has excellent electric conductivity and is long-lived under high-temperature conditions, and in particular, it relates to a rolling apparatus, which is preferably used as a rolling or sliding portion of machines used under high-temperature and high-speed conditions including car electrical components such as alternators or electromagnetic clutches; auxiliary equipment for car engine such as idler pulleys; and business machines such as copying machines or printers.

2. Description of the Related Art (1) A rolling apparatuses (e.g. rolling bearings, linear guide apparatuses, ball screws, etc.), which are used in electronic intelligence equipment such as a hard disk drive (hereinafter referred to as HDD) or laser beam printer (LBP), semi conductor manufacturing machines and others, are required to have various performances such that these apparatuses generate a few dusts, have low torque and excellent acoustic performance, and are long-lived.

Moreover, with the development of high-precision electronic intelligence equipment and semiconductors in recent years, the use conditions (temperature, speed, etc.) of rolling apparatuses, which are used in electronic intelligence equipment and semiconductor manufacturing machines, have become increasingly strict. Under such strict use conditions, the above stated various types of performance are required to be excellent.

For example, in the case of electronic intelligence equipment such as HDD used under a clean atmosphere, if a gaseous oil or the fine particles of grease are released from the inside of a bearing when a rolling apparatus rotates, the fine particles pollute a recording medium or the like and cause operation errors. Therefore, it is most important to suppress the amount of dusts generated.

As a grease composition enclosed in such a rolling bearing for HDD, Undock C (Trade name), which is a grease comprising a mineral oil as a base oil and a sodium complex soap as a thickener, is well known, and this product has been used over 20 years because it causes a small amount of dusts.

When excellent performance of low torque and low noise is required, a grease comprising a lithium soap as a thickener and an ester oil as a base oil has been used at times.

Moreover, Japanese Patent Laid-Open No. 2000-109874 discloses a fluoro grease composition obtained by mixing a silicone oil into a fluoro grease consisting of a fluoro oil and a thickener. This fluoro grease composition has a property such that oil does not leak so much from the grease.

Furthermore, Japanese Patent Laid-Open No. 2001-187892 discloses a grease composition comprising a silicone oil as a base oil, polytetrafluoroethylene as a thickener, silica aerogel and an extreme-pressure additive. This grease composition has a property such that it has excellent low-temperature flow property, wear resistance, heat resistance and low torque property at a low temperature.

However, in the above sodium complex soap-mineral oil grease, the dispersibility of the thickener is insufficient and so it hardly becomes homogenous, and thereby problems regarding acoustic and vibration performances occur in the early stage of rotation of the rolling bearing. In addition, since this grease has strong hygroscopicity and gets hard over time, and thereby the flow property in the rolling bearing decreases, this grease also has a problem of causing insufficient lubrication and readily generating abnormal sounds from the cage.

Therefore, when excellent performance of low torque and low noise is required, the above described lithium soap-ester oil grease has been used at times. However, since this grease easily disperses (causes a large amount of dusts), there is a great risk that the grease might pollute a recording medium or the like when it is used in a rolling bearing for HDD. Moreover, since the temperature used for the rolling bearing for HDD is more and more increased, the above described lithium soap-ester oil grease cannot be applied in some cases.

Further, the grease compositions as disclosed above in Japanese Patent Laid-Open Nos. 2000-109874 and 2001-187892 comprise a very expensive silicone oil or fluoro oil, these grease compositions are expensive when compared with common greases.

Thus, it is a first object of the present invention to solve the above described problems of the prior art techniques and to provide a grease composition which is hardly dispersed and has excellent high-temperature performance. Moreover, it is also the first object of the present invention to provide a rolling apparatus, which has low torque and excellent acoustic performance, and generates a few dusts.

(2) Cars (passenger cars) tend to be directed towards downsizing, weight saving and the expansion of the living space, and therefore cars are forced to reduce their engine room space. For this reason, the downsizing and weight saving of electrical components or auxiliary equipment for car engine are increasingly progressing. In addition, cars are required for silence improvement, the hermeticity of the engine room is progressing, and thereby the temperature in the engine room becomes higher. Accordingly, the above described components or equipment for cars are also required for high-temperature resistance property. For example, bearings for electrical fan motors had previously been used at a bearing temperature of 130° C. to 150° C., but in recent years, the same bearings have been required to resist a high temperature of 180° C. to 200° C.

As described in Japanese Patent Publication No. 2977624, bearings used under high-temperature environment of 150° C. or higher have previously been dealt with by filling the inside of the bearing with a grease obtained by mixing a lithium soap and a urea compound into a synthetic oil type lubricating oil. However, under a high-temperature condition of 160° C. or higher, even this grease generates seizure in an early stage, and so a grease having further higher heat resistance is required.

On the other hand, in OA machines, especially in copying machines or the like, since color fine particles (toner) consisting of a thermoplastic resin and a coloring agent is fused by heating and then fixed on a paper by pressure, a heater is inserted into the axis of a roller, and therefore the temperature of the rolling bearing of a bearing portion sometimes rises to 140° C. to 200° C., depending on the models. Therefore, for such rolling bearings, a grease having excellent heat resistance should be used.

For example, a fluoro grease comprising polytetrafluoroethylene (PTFE) as a thickener and a perfluoropolyether oil (PFPE oil) as a base oil has excellent heat resistance, and so a rolling bearing filled with this fluoro grease can be used under high-temperature environment of 160° C. or higher.

However, since it is difficult to add additives that can be mixed into common greases into the above described fluoro greases, these greases are likely to have poor lubricating ability, rust protection and a metallic corrosion preventing property. Moreover, the fluoro greases have another disadvantage in that these greases are more expensive than synthetic oil type greases by approximately 5 to 20 times.

Japanese Patent Laid-Open No. 11-181465 describes a grease composition, heat resistance of which is improved by blending a fluoro oil with a urea grease. However, since a mineral oil or synthetic oil that is a base oil of the urea grease has a poor affinity for a fluoro oil, the above grease composition has a high oil separation percentage, and therefore this grease composition has a disadvantage in that the use of the grease composition is inappropriate for a bearing used in components which rotate at a high speed.

Thus, it is a second object of the present invention to solve the above described problems of the prior art techniques and to provide a grease composition having excellent lubricating ability and heat resistance. Moreover, it is also the second object of the present invention to provide a rolling apparatus, which has excellent lubricating ability and is long-lived under high-temperature conditions.

(3) With the development of mechanical technology in recent years, mechanical devices tend to be directed towards downsizing, weight saving and high-speed rotation. Mechanical portions such as a bearing and a gear become increasingly exposed at a high temperature. Therefore, in such mechanical portions, a grease used at a high temperature is used. Moreover, a grease used at a high temperature is used also for bearings which are used under high-temperature conditions, such as bearing integrated into iron manufacturing machines (e.g. continuous casting machines, rolling mill for iron and steel, etc.,) various heat processing apparatus or driers.

Examples of such a high-temperature grease include a metallic soap grease which uses, as a thickener, a metallic soap such as Ca, Al, or Li, and a complex metallic soap; an organic grease which uses an organic compound such as polyurea, a terephthalamic acid metal salt or a fluoro resin; and an inorganic grease which uses an inorganic compound such as bentonite.

However, each of these greases also has a disadvantage. For example, the metallic soap grease such as an alminum complex grease has excellent lubricating ability, but it cannot maintain the grease structure for a long time under high-temperature conditions. The grease comprising polyurea is likely to cause hardening phenomenon, and the grease comprising a terephthalamic acid metal salt has large oil separation. Further, the grease comprising bentonite has insufficient rust protection, extreme-pressure property and water resistance.

As a grease which solves the above problems, a grease obtained by adding dibasic acid esthers into organic bentonite to enhance rust protection is known (Japanese Patent Laid-Open No. 6-200273). There is also known a grease obtained by adding the metal salt of carboxylic acid with a substitution at condensed ring into organic bentonite to enhance a metallic corrosion preventing property (Japanese Patent Publication No. 2711150).

However, the grease described in the above Patent Publication still has a problem regarding insufficient extreme-pressure property and water resistance.

Thus, it is a third object of the present invention to solve the above described problems of the prior art techniques and to provide a grease composition having excellent rust protection, extreme-pressure property, water resistance and lubricating life. Moreover, it is also the third object of the present invention to provide a rolling apparatus, which is long-lived although it is used under strict conditions.

(4) As stated above, with the development of mechanical technology in recent years, mechanical devices tend to be directed towards downsizing, weight saving and high-speed rotation, and rolling bearings used in electrical machines surrounding a car engine also tend to have a high temperature. On the other hand, resources and power saving efforts are required, and maintenance-free mechanical devices are also required. Accordingly, rolling bearings are required not only for heat resistance but also for reliability and durability.

Presently, in rolling bearings used under high-temperature environment over 180° C., a fluoro grease, clay mineral grease or the like is generally charged. However, although these greases are excellent in heat resistance, they have a disadvantage in that they have poor lubricating ability, load carring capacity and rust protection.

As a grease satisfying conditions such as rust protection, heat resistance and load carring capacity, a calcium sulfonate complex grease which comprises, as a thickener, a calcium sulfonate complex containing calcium carbonate is known (Japanese Patent Publication No. 5-8760). However, when this calcium sulfonate complex grease is used under high-temperature conditions over 180° C., it does not have the same level of heat resistance as a fluoro grease.

Thus, it is a fourth object of the present invention to solve the above described problems of the prior art techniques and to provide a grease composition having excellent heat resistance, lubricating ability and rust protection. Moreover, it is also the fourth object of the present invention to provide a rolling apparatus, which has heat resistance so that it can be used under high-temperature conditions over 180° C., as well as having excellent load carring capacity, durability and rust protection, and particularly to provide a rolling bearing which is preferably used in electrical machines surrounding a car engine.

(5) Cars (passenger cars) tend to be directed towards downsizing, weight saving and the expansion of the living space, and therefore cars are forced to reduce their engine room space. For this reason, the downsizing and weight saving of electrical components or auxiliary equipment for car engine are increasingly progressing. In addition, cars are required for silence improvement, the hermeticity of the engine room is progressing, and thereby the temperature in the engine room becomes higher. Accordingly, the above described components or equipment for cars are also required for high-temperature resistance property.

At present, as a grease composition used for the rolling bearing of each of the above components, a grease composition comprising a synthetic oil as a base oil and a urea compound as a thickener is mainly used, and this urea compound-synthetic oil grease has excellent lubricating ability up to a temperature of 170° C. to 180° C. However, under high temperature conditions of 200° C. or higher, the evaporation of the base oil, the hardening of the grease associated therewith, and the softening of the grease by the construction of the thickener occur, and therefore there is a risk that a rolling bearing filled with the urea compound-synthetic oil grease might generate seizure in an early stage.

Moreover, as described in Japanese Patent Laid-Open No. 11-72120, in the rolling bearing used in each of the above components, there are some cases where hydrogen generates by water present in the bearing, and the generated hydrogen enters in a bearing steel constituting an inner ring, an outer ring and rolling elements, thereby causing a flaking of formed white structure due to hydrogen brittleness. This is considered to occur as a result of the phenomenon that a direct electric current is generated by metallic contact by vibration or the like at a portion between the inner and outer rings which becomes isolated by the oil film of a lubricant, and that hydrogen ions thereby generate from the water present in the bearing. The generation of hydrogen and the flaking of formed white structure thereby can significantly be controlled by the impartation of electric conductivity to a grease.

On the other hand, in OA machines, especially in copying machines or the like, since color fine particles (toner) consisting of a thermoplastic resin and a coloring agent is fused by heating and then fixed on a paper by pressure, a heater is inserted into the axis of a roller, and therefore the temperature of the rolling bearing of a bearing portion sometimes rises to 140° C. to 200° C., depending on the models. Therefore, for such rolling bearings, a grease having excellent heat resistance should be used.

Moreover, as described above, since the inner and outer rings of a rolling bearing become isolated by the oil film of a lubricant, static electricity generates by rotation. Since the radiation noise has adverse effects such as distortion on the copying screen of a copying machine, as described, for example, in Japanese Patent Publication No. 63-24038, there is taken a countermeasure of charging a grease with electric conductivity in a rolling bearing to electrify the portion between inner and outer rings, thereby eliminating static electricity.

For example, a fluoro grease comprising polytetrafluoroethylene (PTFE) as a thickener and a perfluoropolyether oil (PFPE oil) as a base oil has excellent heat resistance, and so a rolling bearing filled with this fluoro grease can be used under high-temperature conditions of 180° C. or higher.

However, since it is difficult to add additives that can be mixed into common greases into the above described fluoro greases, these greases are likely to have poor lubricating ability, rust protection and a metallic corrosion preventing property. Moreover, the fluoro greases have another disadvantage in that these greases are more expensive than synthetic oil type greases by approximately 5 to 20 times.

Japanese Patent Laid-Open No. 11-181465 describes a grease composition, heat resistance of which is improved by blending a fluoro oil with a urea grease. However, since a mineral oil or synthetic oil that is a base oil of the urea grease has a poor affinity for a fluoro oil, the above grease composition has a high oil separation percentage, and therefore there is a disadvantage that the use of this grease composition is inappropriate for a bearing used in components which rotate at a high speed.

Thus, it is a fifth object of the present invention to solve the above described problems of the prior art techniques and to provide a grease composition having excellent lubricating ability and electric conductivity. Moreover, it is also the fifth object of the present invention to provide a rolling apparatus, which has excellent electric conductivity and is long-lived under high-temperature conditions.

(6) As stated above, grease composition are classified into the following 4 types according to the types of a thickener:

(i) a metallic soap grease comprising a metallic soap such as Li, Ca, Na or Al;

(ii) a complex metallic soap grease comprising a complex metallic soap such as Li, Ca, Na and Al;

(iii) an organic grease comprising an organic compound (an organic thickener) such as polyurea, a terephthalamic acid metal salt or a calcium sulfonate complex; and (iv) an inorganic grease comprising an inorganic compound (an inorganic thickener) such as bentonite or silica gel.

However, as described in the "Lubrication Control Manual Book" edited by the Japan Lubricating Oil Society and the Lubrication Control Diffusion Task Force (the Japanese Lubricating Oil Society, published Mar. 20, 1990) and "A Brief History of Lubricating Greases" written by Arthur T. Polishuk (Llewellyn & McKane, Inc., published 1998), it has previously been thought that, when different types of grease compositions are mixed, the properties of the grease compositions are altered and deteriorated in many cases. This deterioration naturally occurs when 2 types from among the above 4 types of grease compositions are mixed, but it could also occur when 2 types of metallic soap greases are mixed, in which the type of metals is different.

When a significant deterioration occurs in a grease, the grease structure is destroyed, significant softening of the grease or decrease of the dropping point occurs, and the grease is liquefied at times. Moreover, there are also cases where additives which are added to a grease composition, act on one another and reduce the performance of the grease composition. For these reasons, it has generally been believed that the mixing of grease compositions should be prevented as much as possible.

Grease compositions used in rolling apparatuses such as a rolling bearing, a ball screw, a linear guide apparatus and a linear bearing are required to have various performances such as lubricating performance, load carring capacity, heat resistance, water resistance, low torque and few dusts generating property. To obtain such a grease component having many excellent performances, a method for mixing grease components each having one of the above performances is considered to be effective. However, probably because it has generally been believed that the mixing of grease components comprising different types of thickener is not good, the above method has seldom been used.

A few examples include Japanese Patent Publication No. 6-31375 disclosing the combined use of an N-substituted terephthalamic acid metal salt and polyurea, Japanese Patent Laid-Open No. 7-268370 (& U.S. Pat. No. 5,948,737 A) disclosing the combined use of a hydrogen-addition grease and a fluoro grease or fluoro oil, and Japanese Patent Laid-Open No. 2001-3074 disclosing the combined use of a sodium soap and a lithium soap.

Although two types of thickener are used in combination, if the excellent performances of both thickener consist with each other, the above described grease component having many excellent performances can be obtained. Thus, the present invention adopts a method involving the combined use of two different types of thickener to achieve the above described first to fifth objects.

SUMMARY OF THE INVENTION (1) The grease composition of the present invention is a grease composition in which two different types of thickeners are used in combination, and the grease composition of the present invention has many excellent performances. A large number of combinations of two types of thickeners can be conceived, but in the present invention, as a first thickener, a fluoro resin is used. That is to say, the grease composition of the present invention is a grease composition comprising a base oil and a thickener, wherein the above thickener consists of a fluoro resin and a second thickener component.

As described later, as the second thickener component, a metallic soap, a complex metallic soap, an N-substituted terephthalamic acid metal salt, organic bentonite, a calcium sulfonate complex or carbon black is used.

It should be noted that a different type of a third thickener may also be used in combination to such an extent that it does not impair the purpose of the present invention.

(2) To achieve the above first object, the present invention has the following features. That is to say, the grease composition of the present invention comprises a metallic soap as the above second thickener component.

Since this grease composition comprises both a fluoro resin and a metallic soap as a thickener, it hardly disperses and has excellent high-temperature performance. Moreover, this grease composition imparts excellent acoustic performance and torque performance to a rolling apparatus in which the grease composition is enclosed.

The above thickener preferably comprises 10 to 80% by mass of the fluoro resin and 90 to 20% by mass of the metallic soap.

If the composition of the thickener is out of the above range, there is a risk that the grease composition might generate an increased amount of dusts or have insufficient high-temperature performance. Moreover, there is also another risk that when the grease composition is charged in a rolling apparatus, the acoustic performance of the rolling apparatus might decrease, or torque might increase.

In order to decrease the amount of dusts generated from the grease composition and to enhance the high-temperature performance so as to enhance the acoustic performance and torque performance of a rolling apparatus in which the grease composition is enclosed, the thickener more preferably comprises 20 to 70% by mass of the fluoro resin and 80 to 30% by mass of the metallic soap.

Furthermore, the content of the above described thickener is preferably 10 to 33% by mass based on the total mass of the composition.

If the content of the thickener is less than 10% by mass, the grease composition becomes too soft and thereby the amount of dust generated increases, and if the content is more than 33% by mass, the grease composition gets so hardened that it becomes difficult for the grease composition to exert sufficient lubricating ability, resulting in a risk of decreasing acoustic durability. Taking into consideration the amount of dusts generated, acoustic durability and worked penetration, the content of the thickener is more preferably 15 to 30% by mass based on the total mass of the composition.

The above base oil preferably comprises 20 to 70% by mass of a perfluoropolyether oil and 80 to 30% by mass of at least one of either a mineral oil or synthetic oil.

Since the grease composition of the present invention comprises the perfluoropolyether oil as a base oil and the fluoro resin as a thickener, it has excellent high-temperature performance. Accordingly, a rolling apparatus in which the grease composition of the present invention is enclosed is long-lived under high-temperature conditions. Moreover, since the viscosity of the base oil of the grease composition is controlled at low, the grease composition is also excellent in low-temperature flow property.

The grease composition described in Examples 1 to 4 of Japanese Patent Laid-Open No. 7-268370 contains a small amount of fluoro oil, the same high-temperature performance as in the present invention cannot be obtained.

Moreover, since the grease composition of the present invention comprises, as a base oil, at least one of either the mineral oil or synthetic oil, various additives can be added thereto, thereby imparting various performances such as lubricating ability, rust protection and a metallic corrosion preventing property to the grease composition. Furthermore, since the grease composition comprises, as abase oil, at least one of either the mineral oil or synthetic oil, the grease composition of the present invention is low-priced when compared with the conventional grease compositions comprising a silicone oil or fluoro oil as a base oil.

If the content of at least one of either the mineral oil or synthetic oil is less than 30% by mass, there is a risk of not obtaining sufficient additive effects when additives are added to the grease composition. Moreover, when the content of at least one of either the mineral oil or synthetic oil is less than 30% by mass, the content of the perfluoropolyether oil exceeds 70% by mass, and the grease composition thereby becomes expensive. In contrast, if the content of at least one of either the mineral oil or synthetic oil exceeds 80% by mass and that of the perfluoropolyether oil is less than 20% by mass, the grease composition has insufficient high-temperature performance.

Moreover, it is preferable that the above perfluoropolyether oil has a kinematic viscosity at 40° C. of 20 to 400 $mm^2/s$, and at least one of either the above mineral oil or synthetic oil has a kinematic viscosity at 40° C. of 50 to 500 $mm^2/s$.

If the kinematic viscosity at 40° C. of each of the above compounds exceeds the above upper limit, there is a risk that the low-temperature flow property of the grease composition might be insufficient and that abnormal sounds might be generated when the rolling apparatus is activated at a low temperature. To the contrary, if the kinematic viscosity of each of the above compounds is less than the above lower limit, it is not appropriate in terms of evaporation loss or lubricating ability. That is, if the viscosity of a base oil is too low, it becomes difficult to form lubricating oil film which is enough to prevent metallic contact between the raceway surface and the rolling elements when the bearing is rotated at a high temperature.

In order to reduce this problem wherever possible, it is more preferable that the above perfluoropolyether oil has a kinematic viscosity at 40° C. of 30 to 200 $mm^2/s$, and at least one of either the above mineral oil or synthetic oil has a kinematic viscosity at 40° C. of 70 to 400 $mm^2/s$.

Furthermore, it is preferable that the grease composition of the present invention has a worked penetration of 190 to 250.

In order to suppress dusts generated from a rolling apparatus in which the grease composition is enclosed, it is preferable to harden the grease composition. However, if the grease composition is too hard, the flow property in the rolling apparatus decreases, resulting in insufficient lubrication and then ready generation of abnormal sounds from a cage. Therefore, the worked penetration of the grease composition is preferably 190 to 250. If the worked penetration is less than 190, the grease composition is so hard that the rolling apparatus filled with the grease composition has decreased acoustic and torque performances. If the worked penetration exceeds 250, the amount of dusts generated from the rolling apparatus increases.

Still further, the rolling apparatus of the present invention directed towards achieving the above first object is a rolling apparatus comprising an inner member having a raceway surface on the outer surface; an outer member which has a raceway surface opposed to the raceway surface of the inner member and is disposed outside of the inner member; and a plurality of rolling elements which are disposed between the two raceway surfaces so as to flexibly roll therebetween, wherein a space, which is formed between the inner member and the outer member and in which the rolling elements are disposed, is filled with the above described grease composition comprising a metallic soap as the second thickener component.

Since the rolling apparatus with the above configuration is filled with a grease composition comprising both a fluoro resin and a metallic soap as thickeners, the rolling apparatus has low torque and excellent acoustic performance, generating a small amount of dusts.

Moreover, a grease composition comprising a complex metallic soap as the above second thickener component can also achieve the above first object. That is to say, the grease composition of the present invention comprises a complex metallic soap as the above second thickener component.

Since this grease composition comprises both a fluoro resin and a complex metallic soap as thickeners, it hardly disperses and has excellent high-temperature performance. Moreover, this grease composition imparts excellent acoustic performance and torque performance to a rolling apparatus in which the grease composition is enclosed. The grease composition comprising the complex metallic soap as the second thickener component has high-temperature performance more excellent than the grease composition comprising the metallic soap as the second thickener component. However, regarding acoustic performance, the grease composition comprising the metallic soap as the second thickener component is more excellent than the grease composition comprising the complex metallic soap as the second thickener component.

Moreover, a rolling apparatus filled with this grease composition can achieve the above first object. That is to say, the rolling apparatus of the present invention comprises an inner member having a raceway surface on the outer surface; an outer member which has a raceway surface opposed to the raceway surface of the inner member and is disposed outside of the inner member; and a plurality of rolling elements which are disposed between the two raceway surfaces so as to flexibly roll therebetween, wherein a space, which is formed between the inner member and the outer member and in which the rolling elements are disposed, is filled with the above described grease composition comprising a complex metallic soap as the second thickener component.

(3) To achieve the above second object, the present invention has the following features. That is to say, the grease composition of the present invention comprises an N-substituted terephthalamic acid metal salt as the above second thickener component.

The above base oil preferably comprises a perfluoropolyether oil and at least one of either a mineral oil or synthetic oil.

Since the grease composition of the present invention comprises the perfluoropolyether oil as a base oil and a fluoro resin as a thickener, it has excellent heat resistance. Moreover, since the viscosity of the base oil is controlled at low, the grease composition is also excellent in low-temperature flow property. Furthermore, since the grease composition comprises, as a base oil, at least one of either the mineral oil or synthetic oil, various additives can be added thereto. Accordingly, the grease composition of the present invention is excellent in lubricating ability, rust protection and a metallic corrosion preventing property.

Further, since the grease composition comprises at least one of either the mineral oil or synthetic oil as a base oil, and the N-substituted terephthalamic acid metal salt as a thickener, the grease composition of the present invention is low-priced when compared with fluoro greases.

Still further, the above thickener preferably comprises 40 to 80% by mass of the fluoro resin and 60 to 20% by mass of the N-substituted terephthalamic acid metal salt.

When the content of the N-substituted terephthalamic acid metal salt is less than 20% by mass and the content of the fluoro resin exceeds 80% by mass, it results in the high cost of the grease composition. To the contrary, when the content of the N-substituted terephthalamic acid metal salt exceeds 60% by mass and the content of the fluoro resin is less than 40% by mass, the heat resistance of the grease composition is insufficient. In order to reduce this problem wherever possible, it is more preferable that the thickener comprises 50 to 70% by mass of the fluoro resin and 50 to 30% by mass of the N-substituted terephthalamic acid metal salt.

Moreover, the above base oil preferably comprises 10 to 90% by mass of the perfluoropolyether oil and 90 to 10% by mass of at least one of either the mineral oil or synthetic oil.

If the content of at least one of either the mineral oil or synthetic oil is less than 10% by mass, sufficient additive effects cannot be obtained when additives are added to the grease composition. If the content of at least one of either the mineral oil or synthetic oil is less than 10% by mass, the content of the perfluoropolyether oil exceeds 90% by mass, thereby resulting in the high cost of the grease composition. To the contrary, if the content of at least one of either the mineral oil or synthetic oil exceeds 90% by mass and the content of the perfluoropolyether oil is less than 10% by mass, the heat resistance of the grease composition is insufficient.

Moreover, the content of the above thickener is preferably 5 to 40% by mass based on the total mass of the composition.

If the content is less than 5% by mass, it becomes difficult to maintain a grease state, but if the content exceeds 40% by mass, the grease composition gets so hardened that it becomes difficult for the grease composition to exert sufficient lubricating ability.

Furthermore, it is preferable that the above perfluoropolyether oil has a kinematic viscosity at 40° C. of 20 to 400 $mm^2/s$, and at least one of either the above mineral oil or synthetic oil has a kinematic viscosity at 40° C. of 20 to 400 $mm^2/s$.

If the kinematic viscosity at 40° C. of each of the above compounds exceeds 400 $mm^2/s$, oil film gets relatively thick and torque becomes large in a rolling apparatus filled with the grease composition of the present invention. Further, there is a risk that the low-temperature flow property of the grease composition might be insufficient and that abnormal sounds might be generated when the rolling apparatus is activated at a low temperature. However, if the kinematic viscosity of each of the above compounds is less than 20 $mm^2/s$, it is not appropriate in terms of evaporation loss or lubricating ability. That is, if the viscosity of the base oil is too low, it becomes difficult to form lubricating oil film which is enough to prevent metallic contact between the raceway surface and the rolling elements when the bearing is rotated at a high temperature.

In order to reduce this problem wherever possible, it is more preferable that the kinematic viscosity at 40° C. of both parties is set at 30 to 200 $mm^2/S$.

Furthermore, the grease composition of the present invention comprises additives, and the content of the additives is preferably 20% or less by mass based on the total mass of the composition.

Further, the rolling apparatus of the present invention directed towards achieving the above second object is a rolling apparatus comprising an inner member having a raceway surface on the outer surface; an outer member which has a raceway surface opposed to the raceway surface of the inner member and is disposed outside of the inner member; and a plurality of rolling elements which are disposed between the two raceway surfaces so as to flexibly roll therebetween, wherein a space, which is formed between the inner member and the outer member and in which the rolling elements are disposed, is filled with the above described grease composition comprising an N-substituted terephthalamic acid metal salt as the second thickener component.

Since the rolling apparatus with the above configuration is filled with a grease composition comprising both a fluoro resin and an N-substituted terephthalamic acid metal salt as thickeners, it is long-lived under high-temperature conditions.

This rolling apparatus, especially a rolling bearing, can preferably be used in car electrical components, auxiliary equipment for car engine, or business machines used under high-speed and/or high-temperature environment.

(4) To achieve the above third object, the present invention has the following features. That is to say, the grease composition of the present invention comprises organic bentonite as the above second thickener component.

Since this grease composition comprises the mixture of a fluoro resin and organic bentonite as a thickener, it has excellent rust protection, extreme-pressure property, water resistance and lubricating life.

The above thickener preferably comprises 5 to 95% by mass of the fluoro resin and 95 to 5% by mass of the organic bentonite.

If the composition of the thickener is out of the above range, there is a risk that the rust protection or lubricating life of the grease composition might become insufficient. To ensure sufficient rust protection or lubricating life, it is more preferable that the thickener comprises 10 to 90% by mass of the fluoro resin and 90 to 10% by mass of the organic bentonite Since the grease composition described in Examples 5 and 6 of Japanese Patent Laid-Open No. 7-268370 does not contain a fluoro resin, the same rust protection or lubricating life as in the present invention cannot be obtained.

The content of the above thickener is preferably 3 to 40% by mass based on the total mass of the composition.

If the content is less than 3% by mass, it becomes difficult to maintain a grease structure, but if the content exceeds 40% by mass, the grease composition gets so hardened that it becomes difficult for the grease composition to exert sufficient lubricating ability.

Moreover, the rolling apparatus of the present invention directed towards achieving the above third object is a rolling apparatus comprising an inner member having a raceway surface on the outer surface; an outer member which has a raceway surface opposed to the raceway surface of the inner member and is disposed outside of the inner member; and a plurality of rolling elements which are disposed between the two raceway surfaces so as to flexibly roll therebetween, wherein a space, which is formed between the inner member and the outer member and in which the rolling elements are disposed, is filled with the above described grease composition comprising organic bentonite as the second thickener component.

The rolling apparatus with this configuration is long-lived, although it is used under stringent conditions.

(5) To achieve the above fourth object, the present invention has the following features. That is to say, the grease composition of the present invention comprises a calcium sulfonate complex as the above second thickener component.

Since this grease composition comprises both the fluoro resin and the calcium sulfonate complex as thickeners, it has excellent heat resistance, lubricating ability and rust protection.

The above thickener preferably comprises 5 to 95% by mass of the fluoro resin and 95 to 5% by mass of the calcium sulfonate complex.

If the composition of the thickener is out of the above range, there is a risk that the heat resistance, lubricating ability and rust protection of the grease composition might become insufficient. In order to reduce this problem wherever possible, it is more preferable that the above thickener comprises 10 to 90% by mass of the fluoro resin and 90 to 10% by mass of the calcium sulfonate complex.

Moreover, the content of the above thickener is preferably 10 to 40% by mass based on the total mass of the composition. If the content is less than 10% by mass, it becomes difficult to maintain a grease state, but if the content exceeds 40% by mass, the grease composition gets so hardened that it becomes difficult for the grease composition to exert sufficient lubricating ability.

Furthermore, the above base oil has a kinematic viscosity at 100° C. of preferably 3 to 60 $mm^2/s$, and more preferably 5 to 40 $mm^2/s$.

Still further, the rolling apparatus of the present invention directed towards achieving the above fourth object is a rolling apparatus comprising an inner member having a raceway surface on the outer surface; an outer member which has a raceway surface opposed to the raceway surface of the inner member and is disposed outside of the inner member; and a plurality of rolling elements which are disposed between the two raceway surfaces so as to flexibly roll therebetween, wherein a space, which is formed between the inner member and the outer member and in which the rolling elements are disposed, is filled with the above described grease composition comprising a calcium sulfonate complex as the second thickener component.

The rolling apparatus with this configuration has heat resistance so that it can be used under high-temperature environment over 180° C., and the rolling apparatus also has excellent load carring capacity, durability and rust protection. Among rolling apparatuses, a rolling bearing comprising a plurality of rolling elements which are disposed between an inner ring and an outer ring so as to flexibly roll therebetween is particularly preferable.

(6) To achieve the above fifth object, the present invention has the following features. That is to say, the grease composition of the present invention comprises carbon black as the above second thickener component.

The above base oil preferably comprises a perfluoropolyether oil and at least one of either a mineral oil or synthetic oil.

Since the grease composition of the present invention comprises the perfluoropolyether oil as a base oil and the fluoro resin as a thickener, it has excellent heat resistance. Moreover, since the viscosity of the base oil of the grease composition is controlled at low, the grease composition is also excellent in low-temperature flow property.

Moreover, since the grease composition of the present invention comprises carbon black as a thickener, it has excellent electric conductivity.

Furthermore, since the grease composition comprises, as abase oil, at least one of either the mineral oil or synthetic oil, various additives can be added thereto, and the grease composition is thereby excellent in various performances such as lubricating ability, rust protection and a metallic corrosion preventing property.

Still further, since the grease composition comprises at least one of either the mineral oil or synthetic oil as a base oil and carbon black as a thickener, the above grease composition is low-priced when compared with the conventional fluoro greases.

The above thickener of the grease composition of the present invention preferably comprises 40 to 80% by mass of the fluoro resin and 60 to 20% by mass of the carbon black. If the content of the carbon black is less than 20% by mass, the electric conductivity becomes insufficient. When the content of the carbon black is less than 20% by mass, the content of the fluoro resin exceeds 80% by mass, resulting in the high cost of the grease composition. To the contrary, if the content of the carbon black exceeds 60% by mass and the content of the fluoro resin is less than 40% by mass, the heat resistance of the grease composition becomes insufficient. In order to reduce this problem wherever possible, it is more preferable that the thickener comprises 50 to 70% by mass of the fluoro resin and 50 to 30% by mass of the carbon black.

Moreover, the content of the above thickener is preferably 5 to 40% by mass based on the total mass of the composition. If the content is less than 5% by mass, it becomes difficult to maintain a grease state, but if the content exceeds 40% by mass, the grease composition gets so hardened that it becomes difficult for the grease composition to exert sufficient lubricating ability.

Furthermore, the above base oil of the grease composition of the present invention preferably comprises 10 to 90% by mass of the perfluoropolyether oil and 90 to 10% by mass of at least one of either the mineral oil or synthetic oil.

If the content of at least one of either the mineral oil or synthetic oil is less than 10% by mass, the carbon black easily coagulates and so it does not become a grease state, and further, sufficient additive effects cannot be obtained when additives are added to the grease composition. Moreover, when the content of at least one of either the mineral oil or synthetic oil is less than 10% by mass, the content of the perfluoropolyether oil exceeds 90% by mass, and the grease composition thereby becomes expensive. In contrast, if the content of at least one of either the mineral oil or synthetic oil exceeds 90% by mass and that of the perfluoropolyether oil is less than 10% by mass, the grease composition has insufficient heat resistance.

Furthermore, it is preferable that the above perfluoropolyether oil has a kinematic viscosity at 40° C. of 20 to 400 $mm^2/s$, and at least one of either the above mineral oil or synthetic oil has a kinematic viscosity at 40° C. of 20 to 400 $mm^2/s$. If the kinematic viscosity at 40° C. of each of both types of the above oils exceeds 400 $mm^2/S$, oil film gets relatively thick and electric resistance value increases in the rolling apparatus supplied with the grease composition of the present invention. Further, there is a risk that the low-temperature flow property of the grease composition might become insufficient and that abnormal sounds might be generated when the rolling apparatus is activated at a low temperature.

However, if the kinematic viscosity of each of the above compounds is less than 20 $mm^2/s$, it is not appropriate in terms of evaporation loss or lubricating ability. That is, if the viscosity of the base oil is too low, it becomes difficult to form lubricating oil film which is enough to prevent metallic contact between the raceway surface and the rolling elements when the bearing is rotated at a high temperature.

In order to reduce this problem wherever possible, it is more preferable that the kinematic viscosity at 40° C. of both base oils is set at 30 to 200 $mm^2/s$.

Moreover, it is preferable to set the DBP oil absorption of the above carbon black at 100 ml/100 g or more, the primary particle size at 100 nm or shorter, and the specific surface area at 50 $m^2/g$ or larger.

Furthermore, the grease composition of the present invention comprises additives, and the content of the additives is preferably 20% or less by mass based on the total mass of the composition.

Still further, the rolling apparatus of the present invention directed towards achieving the above fifth object is a rolling apparatus comprising an inner member having a raceway surface on the outer surface; an outer member which has a raceway surface opposed to the raceway surface of the inner member and is disposed outside of the inner member; and a plurality of rolling elements which are disposed between the two raceway surfaces so as to flexibly roll therebetween, wherein a space, which is formed between the inner member and the outer member and in which the rolling elements are disposed, is filled with the above described grease composition comprising carbon black as the second thickener component.

Since the rolling apparatus with this configuration is filled with the grease composition comprising both the fluoro resin and the carbon black as thickeners, it has excellent electric conductivity and is long lived under high-temperature conditions.

This rolling apparatus, especially a rolling bearing, can preferably be used in car electrical components such as alternators and electromagnetic clutches, or auxiliary equipment for car engine such as idler pulleys. Moreover, it can preferably be used also for business machines such as copying machines and printers.

(7) Examples of the rolling apparatus of the present invention directed towards achieving the above described first to fifth object includes various apparatuses such as rolling bearings, ball screws, linear guide apparatuses and linear bearings.

The term "inner member" for the rolling apparatus of the present invention is used to mean a bearing inner ring when the rolling apparatus is a rolling bearing. Likewise, the term "inner member" is used to mean a screw shaft when the rolling apparatus is a ball screw, a guide rail when it is a linear guide apparatus, and a shaft when it is a linear bearing, respectively. The term "outer member" is used herein to mean a bearing outer ring when the rolling apparatus is a rolling bearing. Likewise, the term "outer member" is herein used to mean a nut when the rolling apparatus is a ball screw, a slider when it is a linear guide apparatus, and an outer casing when it is a linear bearing, respectively.

(8) Each of the components of the grease composition of the present invention will be explained below.

Fluoro Resin:

The type of the fluoro resin used as a thickener in the present invention is not particularly limited, and preferred examples include polytetrafluoroethylene (PTFE); a copolymer of tetrafluoroethylene and another ethylene unsaturated hydrocarbon monomer, the entire or a part of which is fluorinated (hereinafter referred to as a tetrafluoroethylene copolymer); and others.

Examples of the tetrafluoroethylene copolymer include the following (1) to (4):

(1) Denatured polytetrafluoroethylene obtained by copolymerizing one or more types of comonomers selected from a group consisting of perfluoroalkyl-trifluoroethylene ether, vinylidene fluoride, hexafluoroisobutene, chlorotrifluoroethylene and perfluoroalkylethylenes (e.g. perfluoropropene, etc.) with PTFE at a ratio of 0.01 to 3 mole %, and preferably 0.05 to 0.5 mole %.

(2) A tetrafluoroethylene (TFE) thermoplastic copolymer obtained by copolymerizing at least one type of perfluoroalkylvinyl ether (wherein the perfluoroalkyl group contains 1 to 6 carbon atoms) with TFE at a ratio of 0.5 to 8 mole %. Examples of such a copolymer include a copolymer of perfluoropropylvinyl ether and TFE, a copolymer of perfluoromethylvinyl ether and TFE, a copolymer of perfluoroethylvinyl ether and TFE, and others.

(3) A TFE thermoplastic copolymer obtained by copolymerizing perfluoro olefin containing 3 to 8 carbon atoms with TFE at a ratio of 2 to 20 mole %. Examples of such a copolymer include a copolymer of hexafluoropropene and TFE, and the like. Other comonomers having a trifluoroethylene ether structure may also be copolymerized with this copolymer, if the ratio is less than 5 mole %.

(4) A TFE thermoplastic copolymer obtained by copolymerizing perfluoromethylvinyl ether (0.5 to 13 mole %) with one or more types of monomers of fluoride represented by the following formulas (I) to (III):

$$R_FO—CF=CF_2 \quad (I)$$

$$R_F—CH=CH_2 \quad (II)$$

(III)

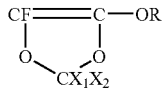

wherein R in formula (III) is a perfluoroalkyl group containing 1 to 5 carbon atoms and it is preferably $CF_3$. Each of $X_1$ and $X_2$ is independently a perfluoroalkyl group containing 1 to 3 carbon atoms or F, and it is preferably $CF_3$.

Moreover, RF in Formulas (I) and (II) is at least one of the following (i), (ii) and (iii):

(i) a perfluoroalkyl group containing 2 to 12 carbon atoms, (ii) a compound having a chemical structure represented by the following formula (IV), wherein r in the formula (IV) is an integer of 1 to 4, and r' is an integer of 0 to 3:

$$—(CF_2CF(CF_3)O)_r(CF_2)_{r'}CF_3 \quad (IV)$$

(iii) a compound having a chemical structure represented by the following formula (V):

$$—Z—(OCFX)_q(OCF_2CFY)_{q'}O—T \quad (V)$$

wherein structural units (OCFX) and ($OCF_2$ CFY) in formula (V) are statistically distributed along a chain. T is a perfluoroalkyl group containing 1 to 3 carbon atoms, and it arbitrarily has one H or Cl. X and Y is F or $CF_3$, and Z is —CFX— or —$CF_2$ CFY—. Further, each of q and q' is an integer of 0 to 10, and the values are identical with or different from each other, wherein the number average molecular weight of the monomer of a fluoride is 200 to 2,000.

In (1), (2), (3) and (4) above, the preferred ranges of the value of the molecular formulas, copolymerization ratio and number average molecular weight are defined as above described. If these values are less than the lower limit of the above range, thickening ability sufficient to convert the grease composition into a grease state is not imparted to the tetrafluoroethylene copolymer. In contrast, if these values are more than the upper limit of the above range, the grease composition gets so hardened that it becomes difficult for the grease composition to exert sufficient lubricating ability.

Specific examples of such a fluoro resin include polytetrafluoroethylene (PTFE), perfluoroalkoxyalkane (PFA), a perfluoroethylene propene copolymer (PFEP), an ethylene-tetrafluoroethylene copolymer (FTFE), polyvinylidene fluoride (PVDF), a polychlorotrifluoroethylene-perfluoro dioxol copolymer (ECTFE), a polytetrafluoroethylene-perfluoro dioxol copolymer (TFE/PDD), polyvinyl fluoride (PVE) and others. Of these, PTFE is the most preferable because of its excellent mass productivity.

Metallic Soap and Complex Metallic Soap:

An example of a metallic soap used as a thickener (second thickener component) together with a fluoro resin in the present invention includes an aliphatic monobasic metal salt which is synthesized from a 1-, 2- or 13-group metal according to the periodic table, and higher fatty acid containing 10 or more carbon atoms or higher hydroxyfatty acid containing one or more hydroxyl group(s) and 10 or more carbon atoms.

Examples of the metal include lithium, sodium, calcium, barium, aluminum and others. Examples of the higher fatty acid include lauric acid, myristic acid, palmitic acid, margaric acid, stearic acid, arachidic acid, behenic acid, lignoceric acid, tallow fatty acid and others. Examples of the higher hydroxyfatty acid include 9-hydroxystearic acid, 10-hydroxystearic acid, 12-hydroxystearic acid, 9,10-dihydroxystearic acid and others. Of these aliphatic monobasic acids, 12-hydroxystearic acid is the most preferable in terms of the stability of the thickener.

An example of a complex metallic soap used as a thickener (second thickener component) together with a fluoro resin in the present invention includes a complex metallic soap which is synthesized by saponifying a 1-, 2- or 13-group metallic hydroxide according to the periodic table and the mixture of fatty acid and dibasic acid. Examples of the metal include lithium, sodium, calcium, barium, aluminum and others. A grease composition comprising the above described complex metallic soap has a higher dropping point than that of a grease composition comprising an ordinary metallic soap, and it is excellent in heat resistance.

This metallic soap and complex metallic soap may be dispersed in a base oil after they are synthesized separately, or may be dispersed in a base oil by synthesizing them in the base oil. However, a thickener is better dispersed in a base oil by the latter method, and so the latter method is advantageous in the industrial production of a grease composition.

N-Substituted Terephthalamic Acid Metal Salt:

An N-substituted terephthalamic acid metal salt used as a thickener (second thickener component) together with a fluoro resin in the present invention is represented by the following general formula (VI):

(VI)

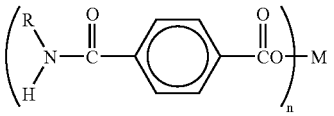

In the general formula (VI), a substituent R binding to a nitrogen atom is a straight chain, branched chain or cyclic, saturated or unsaturated, monovalent hydrocarbon group, M is a metal, and n denotes a number equivalent to the valence of the metal.

When the substituent R is a straight or branched chain hydrocarbon group, the hydrocarbon group contains 10 to 32, preferably 12 to 22 carbon atoms, and when the substituent R is a cyclic hydrocarbon group, the hydrocarbon group contains 6 to 28, preferably 7 to 22 carbon atoms. If the number of carbon atoms of the hydrocarbon group is smaller than the above described minimum value, the thickener is hardly dispersed in a base oil and further the thickener is likely to separate from the base oil. To the contrary, if the number of carbon atoms of the hydrocarbon group is greater than the above maximum value, then the production of the thickener is industrially unrealistic.

Examples of the substituent R include a decyl group, a tetradecyl group, a hexadecyl group, an octadecyl group, a cyclohexyl group, a benzyl group, a phenyl group, a tolyl group, a butylphenyl group and others. Examples of the metal M include 1-,2-, 12-and 13-group metals according to the periodic table, and examples of such a metal include lithium, potassium, sodium, magnesium, calcium, barium, zinc, aluminum and others. Of these, sodium, barium, lithium and potassium are particularly preferable, and sodium is the most preferable because of its excellent mass productivity.

Such an N-substituted terephthalamic acid metal salt may be synthesized separately and then dispersed in a base oil, or may be dispersed in the base oil by synthesis in the base oil. However, since the thickener is better dispersed in a base oil by the latter method, when the thickener is industrially produced, the latter method is advantageous.

Organic Bentonite:

Organic bentonite used as a thickener (second thickener component) together with a fluoro resin in the present invention is one type of colloidal clay which is naturally produced, and it is obtained by treating bentonite that is ferro silicate (laminar silicate) such as montmorillonite with a cationic surfactant. When bentonite is treated with a cationic surfactant, organic molecules are adsorbed between the crystalline layers of the bentonite so as to obtain lipophilic organic bentonite which swells well in an organic liquid in the presence of a polar dispersing agent.

Bentonite, an important element constituting organic bentonite, is complicated silicate containing a large amount of water of crystallization and has a structure containing the layers of ion alignments laminated in parallel. That is, two silicate layers are disposed in parallel, and a layer of alkaline metal, alkaline earth metal or water molecules is interposed between the silicate layers. More specifically, in the above layer has a three-layer structure, two tetrahedral layers of Si are disposed in parallel, with the tetrahedrons opposing to each other on the vertexes, and an octahedral layer of Al is interposed between the tetrahederal layers.

In such bentonite, since the binding strength between the metal ion locating in the interlamillar portion and the silicate is relatively weak, an ion exchange reaction occurs, for example, between a quarternary ammonium salt and the metal ion, by treatment with a cationic surfactant, and as a result, what is called organic bentonite is obtained. By this reaction, hydrophilic bentonite is changed to lipophilic one.

A production method of organic bentonite and the like are disclosed in detail, for example, in Japanese Patent Laid-Open Nos. 62-83108 and 53-72792.

Organic bentonite may be synthesized separately and then dispersed in a base oil, or may be dispersed in the base oil by synthesis in the base oil. However, since the thickener is better dispersed in a base oil by the latter method, when the thickener is industrially produced, the latter method is advantageous.

Calcium Sulfonate Complex:

A calcium sulfonate complex used as a thickener (second thickener component) together with a fluoro resin in the present invention comprises calcium sulfonate as an essential component, and also comprises at least one type of calcium salt (calcium soap) selected from a group consisting of (a) calcium carbonate, (b) a higher fatty acid calcium salt such as calcium dibehenate, calcium distearate and calcium dihydroxystearate, (c) a lower fatty acid calcium salt such as calcium acetate, and (d) calcium borate.

It is particularly preferable to use a calcium sulfonate complex, which comprises calcium sulfonate and calcium carbonate as essential components and also comprises two or more selected from a group consisting of calcium dibehenate, calcium distearate, calcium dihydroxystearate, calcium acetate and calcium borate.

In terms of thickening effect, the above described calcium sulfonate preferably has a base number of 50 to 500 mgKOH/g, and more preferably it is overbased calcium sulfonate with a base number of 300 to 500 mgKOH/g.

The calcium sulfonate complex may be dispersed in a base oil after it is synthesized separately, or the calcium sulfonate complex may also be dispersed in a base oil by synthesis in the base oil. However, since the thickener is better dispersed in a base oil by the latter method, when the thickener is industrially produced, the latter method is advantageous.

Carbon Black:

Carbon black used as a thickener (second thickener component) together with a fluoro resin in the present invention acts as an electric conductivity imparting additive as well as a thickener in the grease composition.

The type of carbon black to be used is not particularly limited, but considering ability to impart thickening capacity and electric conductivity to the grease composition, carbon black having large oil absorption capacity (DBP oil absorption being 100 ml/100 g or more) is preferable. Moreover, it is preferable to use carbon black having lipophilic property and a large specific surface area (the primary particle size being less than 100 nm and the specific surface area being 50 $m^2/g$ or larger.)

If the DBP oil absorption, primary particle size and specific surface area of carbon black are out of the above range, there is a risk that the thickening capacity and electric conductivity of the grease composition might become insufficient. The above specific surface area is determined by e.g. nitrogen adsorption method.

Specific examples of the carbon black include acetylene black, Ketjen black, channel black and others. Of these, acetylene black is particularly preferable, since it has a developed carbon structure by thermal decomposition.

This carbon structure consists of primary particles (the average particle size being 0.026 to 0.042 μm by electron microscopy), in which crystallites obtained by the lamination of net planes of carbons are aggregated. A large number of the primary particles are connected to construct a chain or resinous structure. Of these acetylene black, one having a significantly small amount of hydrogen that is considered to fix the motion of π electrons is preferable. Of commercially available acetylene black, easy-to-handle granular acetylene black as well as powder acetylene black may be used. Not only acetylene black but also other carbon black such as gas black can be used, as long as they have the developed carbon structure as described above.

Base Oil:

The type of a base oil used in the grease composition of the present invention is not particularly limited, but the base oil preferably comprises at least one of either a mineral oil or synthetic oil and a perfluoropolyether oil. However, other types of oils maybe used in combination to such an extent that it does not impair the purpose of the present invention.

The type of the mineral oil is not particularly limited, but a paraffin mineral oil, a naphthene mineral oil, a mixed oil thereof, and others, are preferably used. The type of the synthetic oil is also not particularly limited, a synthetic hydrocarbon oil, an ether oil, an ester oil, a fluoro oil and others are preferably used.

Specific examples of the synthetic hydrocarbon oil include a poly α-olefin oil, a cooligomer synthetic oil of α-olefin and ethylene, and others.

An example of the ether oil includes a phenyl ether oil substituted by an alkyl group(s) containing 12 to 20 carbon atoms (e.g. a diphenyl ether oil, a triphenyl ether oil, a tetraphenyl ether oil, etc.). The number of alkyl groups substituted is not particularly limited, but one or two are preferable. Taking into consideration the low vaporizability of the base oil, an alkyl diphenyl ether oil is preferable.

Examples of the fluoro oil include a perfluoroether oil and a derivative thereof, a fluorosilicone oil, a chlorotrifluoroethylene oil, a fluorophosphazene oil and others.

Moreover, examples of the ester oil include a diester oil, a polyol ester oil (e.g. a neopentyl-type polyol ester oil, etc.), a complex ester oil thereof, an aromatic ester oil, a carbonate oil and others.

The diester oil is obtained by a reaction between dibasic acid and alcohol, and examples of the diester oil include dioctyl adipate, diisobutyl adipate, dibutyl adipate, dibutyl sebacate, dioctyl sebacate, methylacetyl ricinolate and others.

Moreover, the polyol ester oil is obtained by a reaction between polyol and one or two or more types of monobasic acid. A complex ester that is oligo ester obtained by a reaction between a mixed fatty acid of monobasic acid and dibasic acid and polyol may also be used.

Examples of the polyol include trimethylolpropane, pentaerythritol, dipentaerythritol, neopentyl glycol, 2-methyl-2-propylpropane-1,3-diol, and others.

A preferred example of the monobasic acid includes fatty acid containing 4 to 18 carbon atoms, and specific examples include valeric acid, caproic acid, caprylic acid, enanthic acid, pelargonic acid, capric acid, undecanoic acid, lauric acid, myristic acid, palmitic acid, tallow fatty acid, stearic acid, caproleic acid, undecylenic acid, linderic acid, tsuzuic acid, physeternic acid, myristoleic acid, palmitoleic acid, petroselinic acid, oleic acid, elaidic acid, asclepinic acid, vaccenic acid, sorbic acid, linolic acid, linolenic acid, sabinic acid, ricinoleic acid and others.

Examples of the aromatic ester oil include trimellitic acid ester such as trioctyl trimellitate or tridecyl trimellitate, and pyromellitic acid ester such as tetraoctyl pyromellitate.

The type of the perfluoropolyether oil used in the grease composition is not particularly limited, but the perfluoropolyether oil is preferably comprised of at least one type selected from the following fluorooxy alkylene structural units. In the following formulas, $X_3$ represents $CF_3(CF_2)_n$—, and n represents an integer of 0 to 4.

$$-(CF_2CF_2O)-,\quad -(CF_2O)-$$
$$-(CF_2CF(CF_3)O)-,\quad -(CF(CF_3)O)-$$
$$-(CF_2CF_2CF_2O)-,\quad -(CF_2CF(OX_3)O)-$$
$$-(CF(OX_3)O)-$$

When the perfluoropolyether oil is comprised of two or more types of the above fluorooxy alkylene structural units, each structural unit is statistically distributed along a chain. The terminal group thereof is a fluoroalkyl group arbitrarily having an H and/or a Cl such as $CF_3$—, $C_2F_5$—, $C_3F_7$—, $CF_2Cl(CF_3)CF$—, $CF_3CFClCF_2$—, $CF_2ClCF_2$—, $CF_2Cl$—, $CHF_2$— or $CF_3CHF$—.

Each of the above described various base oils may be used singly, or may be used appropriately in combination of two or more types. Taking into consideration the lubricating ability and life of the rolling apparatus under high-temperature and high-speed conditions into which the grease composition is enclosed, it is preferable that a synthetic oil is contained in the base oil, and it is more preferable that at least one type selected from an ester oil, an ether oil and a fluoro oil is contained in the base oil. Of the ester oils, a polyol ester oil and an aromatic ester oil are further preferable, of the ether oils, an alkyldiphenyl ether oil is further preferable, and of the fluoro oils, a perfluoroether oil, a derivative thereof and a fluorophosphazene oil are further preferable.

Additive:

Various additives may be added, as desired, to the grease composition of the present invention so as to improve various performances of the grease composition. For example, additives such as an antioxidant, a rust preventive, an extreme-pressure additive, an oiliness improver and a metal deactivator, which are generally used for grease compositions, can be used singly or in combination of two or more.

Examples of the antioxidant include amine antioxidants, phenol antioxidants, sulfur antioxidants, zinc dithiophosphate and others.

Specific examples of an amine antioxidant include phenyl-1-naphthylamine, phenyl-2-naphthylamine, diphenylamine, phenylenediamine, oleyl amide amine, phenothiazine and others.

Specific examples of a phenol antioxidant include hindered phenols or the like such as p-t-butylphenyl salicylate, 2,6-di-t-butylphenol, 2,6-di-t-butyl-p-phenylphenol, 2,2'-methylenebis(4-methyl-6-t-octylphenol), 4,4'-butylidenebis-6-t-butyl-m-cresol, tetrakis {methylene-3-(3',5'-di-t-butyl-4'-hydroxyphenyl)p ropionate}methane, 1,3,5-trimethyl-2,4,6-tris(3,5-di-t-butyl-4-hydroxybenzyl) benzene, n-octadecyl-β-(4'-hydroxy-3',5'-di-t-butylphenyl) propiona te, 2-n-octyl-thio-4,6-di(4'-hydroxy-3',5'-di-t-butyl)phenoxy -1,3,5-triazine, 4,4'-thiobis(6-t-butyl-m-cresol), 2-(2'-hydroxy-3'-t-butyl-5'-methylphenyl)-5-chlorobenzotr iazole and others.

Examples of a rust preventive include petroleum sulfonate, an organic sulfonic acid metal salt (herein, metal is an alkali metal, alkaline-earth metal or the like), esters and others.

Specific examples of an organic sulfonic acid metal salt include the metal salt of dinonylnaphthalene sulfonic acid or heavy alkylbenzene sulfonic acid (calcium sulfonate, barium sulfonate, sodium sulfonate, etc.), and others.

Specific examples of esters include sorbitan esters such as sorbitan monolaurate, sorbitan tristearate, sorbitan monooleate and sorbitan trioleate, which are the partial esters of polybasic carboxylic acid and polyol; alkyl esters such as polyoxyethylene laurate, polyoxyethylene oleate and polyoxyethylene stearate; and others.

Moreover, alkyl succinic acid derivatives and alkenyl succinic acid derivatives such as alkyl succinic acid ester and alkenyl succinic acid ester can also preferably be used as rust preventives.

The grease composition of the present invention has a rust protection property by itself, but the rust protection property is further improved by adding the above rust preventives.

Furthermore, examples of an extreme-pressure additive include phosphorus extreme-pressure additives, zinc dithiophosphate, organic molybdenum and others.

Still further, examples of an oiliness improver include fatty acid such as oleic acid or stearic acid; alcohol such as lauryl alcohol or oleyl alcohol; amine such as stearylamine or cetylamine; phosphoric ester such as tricresyl phosphate; animal and vegetable oils; and others.

Still further, an example of a metal deactivator includes benzotriazole or the like.

The additive amount of these additives is not particularly limited unless it impairs the purpose of the present invention, but it is preferably 20% or less by mass based on the total mass of the grease composition. If the additive amount exceeds 20% by mass, the additive effects are not improved, and there is also a risk that the lubricating ability might lower since the amount of a base oil is relatively reduced.

The production method of the grease composition of the present invention is not particularly limited. For example, a fluoro grease comprising a perfluoropolyether oil as a base oil and a fluoro resin as a thickener; and a grease composition comprising at least one of either a mineral oil or synthetic oil as a base oil and a second thickener component such as a metallic soap or carbon black as a thickener, are produced separately, and these are then mixed. Otherwise, the grease composition of the present invention can also be produced by adding the fluoro resin and the second thickener component as thickeners into the base oil obtained by mixing the perfluoropolyether oil and at least one of either the mineral oil or synthetic oil.

The former method is a method of mixing the previously produced grease composition, and therefore the fluoro oil can be used as a base oil. Moreover, in the latter method, the fluoro oil can be used, if the amount is within 5 volume % based on the total volume of the base oil.

DETAILED DESCRIPTION OF THE PREFERRED EMBODIMENTS

Figure 1:
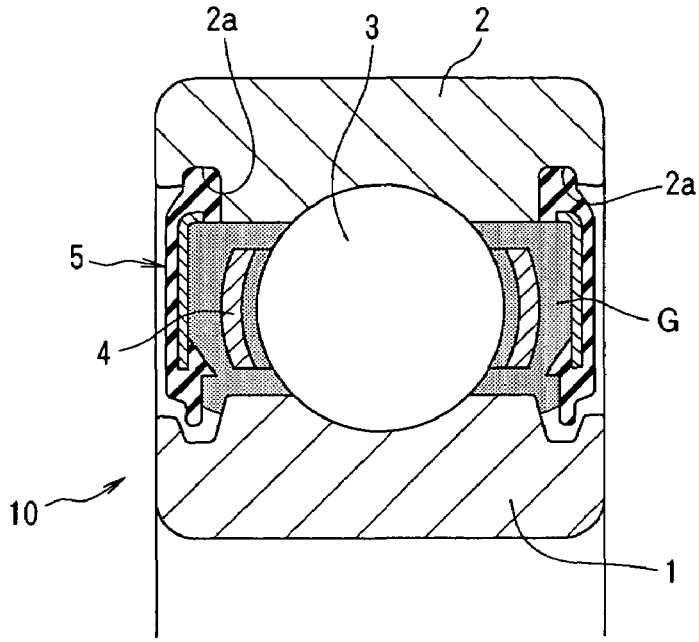
FIG. 1 is a partial longitudinal sectional view showing the configuration of a deep groove ball bearing, which is one embodiment of the rolling apparatus of the present invention.

The embodiments of the grease composition and the rolling apparatus of the present invention will be explained in detail, while referring to figures.

(A) Grease composition comprising fluoro resin and metallic soap as thickener

Tables 1 to 3 show the compositions of the grease compositions of Examples and Comparative examples. NLGI worked penetration of each grease composition is also shown in the tables. The worked penetration is determined according to JIS K2220.

TABLE 1

| | Example A1 | Example A2 | Example A3 | Example A4 | Example A5 | Example A6 |
|---|---|---|---|---|---|---|
| Type of thickener[1)] | | | | | | |
| Li soap[2)] | 60 | 30 | 80 | 30 | 30 | — |
| Ca soap[3)] | — | — | — | 30 | — | 30 |
| Na soap[4)] | — | — | — | — | 30 | 30 |
| PTFE[5)] | 40 | 70 | 20 | 40 | 40 | 40 |
| Content of thickener[1)] | 23 | 29 | 19 | 24 | 24 | 25 |
| Type of base oils[1)] | | | | | | |
| POE oil[6)] | 60 | 30 | 80 | 60 | 60 | 60 |
| PFPE oil[7)] | 40 | 70 | 20 | 40 | 40 | 40 |
| Content of base oil[1)] | 77 | 71 | 81 | 76 | 76 | 75 |
| Worked penetration | 221 | 240 | 210 | 220 | 216 | 222 |
| Amount of dusts generated in the early stage of rotation[8)] | | | | | | |
| 25° C. | 750 | 400 | 900 | 650 | 550 | 500 |
| 70° C. | 3250 | 2100 | 4400 | 3550 | 3250 | 2700 |
| Acoustic performance in the early stage of rotation | ○ | ○ | ○ | ○ | ○ | ○ |
| Torque value in the early stage of rotation | ○ | ○ | ○ | ○ | ○ | ○ |
| Durability (hr) | >3000 | >3000 | >3000 | >3000 | >3000 | >3000 |
| Amount of dusts generated after durability test[8)] | 4200 | 3300 | 5250 | 3950 | 3700 | 3450 |

[1)]Unit of value is % by mass
[2)]Lithium 12-hydroxystearate
[3)]Calcium 12-hydroxystearate
[4)]Sodium 12-hydroxystearate
[5)]Polytetrafluoroethylene
[6)]Polyol ester oil
[7)]Perfluoropolyether oil
[8)]Unit is particles/283 $cm^3$

TABLE 2

| | Example A7 | Example A8 | Example A9 | Example A10 | Example A11 | Example A12 |
|---|---|---|---|---|---|---|
| Type of thickener[1)] | | | | | | |
| Li soap[2)] | 60 | 30 | 80 | 30 | 30 | — |
| Ca soap[3)] | — | — | — | 30 | — | 30 |
| Na soap[4)] | — | — | — | — | 30 | 30 |
| PTFE[5)] | 40 | 70 | 20 | 40 | 40 | 40 |
| Content of thickener[1)] | 23 | 29 | 19 | 24 | 24 | 25 |
| Type of base oils[1)] | | | | | | |
| ADPE oil[6)] | 60 | 30 | 80 | 60 | 60 | 60 |
| PFPE oil[7)] | 40 | 70 | 20 | 40 | 40 | 40 |
| Content of base oil[1)] | 77 | 71 | 81 | 76 | 76 | 75 |
| Worked penetration | 219 | 235 | 203 | 215 | 207 | 214 |
| Amount of dusts generated in the early stage of rotation[8)] | | | | | | |
| 25° C. | 650 | 450 | 800 | 550 | 500 | 450 |
| 70° C. | 3150 | 2200 | 4150 | 3350 | 3200 | 2400 |
| Acoustic performance in the early stage of rotation | ○ | ○ | ○ | ○ | ○ | ○ |
| Torque value in the early stage of rotation | ○ | ○ | ○ | ○ | ○ | ○ |
| Durability (hr) | >3000 | >3000 | >3000 | >3000 | >3000 | >3000 |
| Amount of dusts generated after durability test[8)] | 4000 | 3350 | 5150 | 3750 | 3550 | 3300 |

[1)]Unit of value is % by mass
[2)]Lithium 12-hydroxystearate
[3)]Calcium 12-hydroxystearate
[4)]Sodium 12-hydroxystearate
[5)]Polytetrafluoroethylene
[6)]Alkyl diphenyl ether oil
[7)]Perfluoropolyether oil
[8)]Unit is particles/283 $cm^3$

TABLE 3

| | Example A13 | Example A14 | Example A15 | Comparative example A1 | Comparative example A2 | Comparative example A3 |
|---|---|---|---|---|---|---|
| Type of thickener[1)] | | | | | | |
| Li soap[2)] | 20 | 60 | 60 | 100 | — | — |
| Ca soap[3)] | — | — | — | — | 100 | — |
| Na soap[4)] | — | — | — | — | — | — |
| PTFE[5)] | 80 | 40 | 40 | — | — | 100 |
| Content of thickener[1)] | 30 | 41 | 9 | 15 | 18 | 35 |
| Type of base oils[1)] | | | | | | |
| ADPE oil[6)] | 20 | 60 | 60 | 100 | 100 | — |
| PFPE oil[7)] | 80 | 40 | 40 | — | — | 100 |
| Content of base oil[1)] | 70 | 59 | 91 | 85 | 82 | 65 |
| Worked penetration | 220 | 170 | 300 | 224 | 217 | 245 |
| Amount of dusts generated in the early stage of rotation[8)] | | | | | | |
| 25° C. | 300 | 200 | 1800 | 2400 | 3000 | 150 |
| 70° C. | 1800 | 1500 | 6750 | 9000 | 12000 | 1200 |
| Acoustic performance in the early stage of rotation | ○ | ○ | ○ | ○ | ○ | x |
| Torque value in the early stage of rotation | ○ | x | ○ | ○ | ○ | x |
| Durability (hr) | 2500 | | >3000 | >3000 | >3000 | |

TABLE 3-continued

| | Example A13 | Example A14 | Example A15 | Comparative example A1 | Comparative example A2 | Comparative example A3 |
|---|---|---|---|---|---|---|
| Amount of dusts generated after durability test[8)] | | | 35000 | 23000 | 33000 | |

[1)]Unit of value is % by mass
[2)]Lithium 12-hydroxystearate
[3)]Calcium 12-hydroxystearate
[4)]Sodium 12-hydroxystearate
[5)]Polytetrafluoroethylene
[6)]Alkyl diphenyl ether oil
[7)]Perfluoropolyether oil
[8)]Unit is particles/283 $cm^3$ The compositions of the grease compositions of Examples A1 to A15 and Comparative examples A1 to A3 are as shown in Tables 1 to 3, and each composition comprises a thickener consisting of a metallic soap and a fluoro resin (PTFE), and a base oil consisting of a synthetic oil and a perfluoropolyether oil (PFPE oil) (except Comparative examples A1 to A3). The metallic soap is the lithium salt, calcium salt or sodium salt of 12-hydroxystearic acid, but a complex metallic soap can also be used instead of the metallic soap. The synthetic oil is a polyolester oil (POE oil) or alkyldiphenylether oil (ADPE oil), and regarding the kinematic viscosity of each oil at 40° C., the POE oil has 70 $mm^2$/S, the ADPE oil has 100 $mm^2$/s, and the PFPE oil has 190 $mm^2$/s.

Although not described in each table, each grease composition comprises, as additives, 1.0% by mass of an amine antioxidant, 0.5% by mass of a calcium sulfonate rust preventive and 0.05% by mass of a benzotriazole metal deactivator based on the total mass of the grease composition.

It should be noted that the content (% by mass) of the base oil and the thickener described in each of Tables 1 to 3 is a value based on that the total mass of the base oil and the thickener is defined as 100, and that the above additives are not considered. Moreover, values described in the columns of the type of thickener and the type of base oil show the mass ratio of each component constituting the thickener and the mass ratio of each component constituting the base oil, respectively, in a case where each of the total mass (% by mass) of the thickener and the total mass of the base oil is defined as 100.

Rolling bearings filled with each of the above 18 types of grease compositions were prepared, and acoustic performance, torque performance, durability, and the amount of dusts generated therefrom were evaluated.

The used rolling bearing was a single-row deep groove ball bearing 10 (inside diameter: 5 mm, outside diameter: 13 mm, width: 4 mm) completely defatted by organic solvent, and this rolling bearing was comprised of: an inner ring 1; an outer ring 2; a plurality of balls 3, which were disposed between the inner ring 1 and the outer ring 2 to flexibly roll therebetween; a cage 4 for retaining the plurality of balls 3 between the inner ring 1 and the outer ring 2; and noncontact rubber seals 5, 5 installed in the seal groove 2*a*, 2*a* of the outer ring 2 (refer to the partial cross-sectional view of FIG. 1). A space portion, which was surrounded by the inner ring 1, the outer ring 2 and the rubber seals 5, 5 of the ball bearing 10, was filled with 19 mg of the above grease composition G, and the rubber seals 5, 5 hermetically sealed the grease composition in the ball bearing 10.

Next, methods of evaluating each of the above various performances will be explained below.

Figure 2:
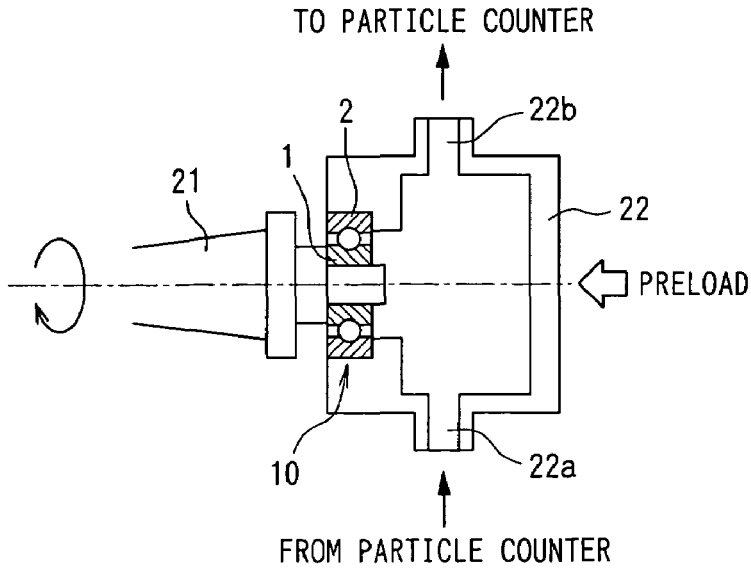
FIG. 2 is a schematic diagram showing the configuration of an apparatus for evaluating the amount of dusts generated from a bearing.

Method for Evaluating the Amount of Dusts Generated From Grease Composition:

As shown in FIG. 2, the inner ring 1 of the ball bearing 10 was mounted on a rotation shaft 21, and the outer ring 2 was mounted on a container 22. The container 22 comprised an air introduction port 22*a* and an air discharge port 22*b*, and clean air was flown into the container 22 through the air introduction port 22*a*, and then the air was flown out of the container 22 through the air discharge port 22*b*.

When the rotation shaft 21 was rotated by a motor which is not shown in the figure and the ball bearing 10 was thereby rotated, dusts were generated from the grease composition G contained in the ball bearing 10, and the particles of the grease composition were dispersed in the container 22. These particles were flown out of the container 22 by the air which was flown in through the air introduction port 22*a*, and then the particles were transported to a particle counter which is not shown in the figure. Thereafter, the number of particles having a particle size of 0.3 μm or greater which were contained in 0.01 cubic feet (283 $cm^3$) of the air, was counted by this particle counter.

The ball bearing 10 was mounted on the container 22 under the condition where a preload of 14.7 N was loaded. Moreover, the rotational speed of the ball bearing 10 was set at 3,600 $min^1$. Under these conditions, the amount of dusts generated was counted both at 25° C. and at 70° C. for 20 minutes.

Thus, the amount of dusts generated in the early stage of rotation of a ball bearing 10, which was counted as above, is also shown in Tables 1 to 3.

Method for Evaluating Acoustic Performance:

The acoustic performance of the ball bearing 10 in the early stage of rotation (the rotational speed was 1,800 $min^{-1}$) was evaluated using an Anderon Meter. The results are also shown in Tables 1 to 3. In each table, when the Anderon value is 2 or less, it is evaluated as satisfactory and shown with the mark ○, and when the Anderon value is more than 2, it is evaluated as unsatisfactory and shown with the mark x.

Figure 3:
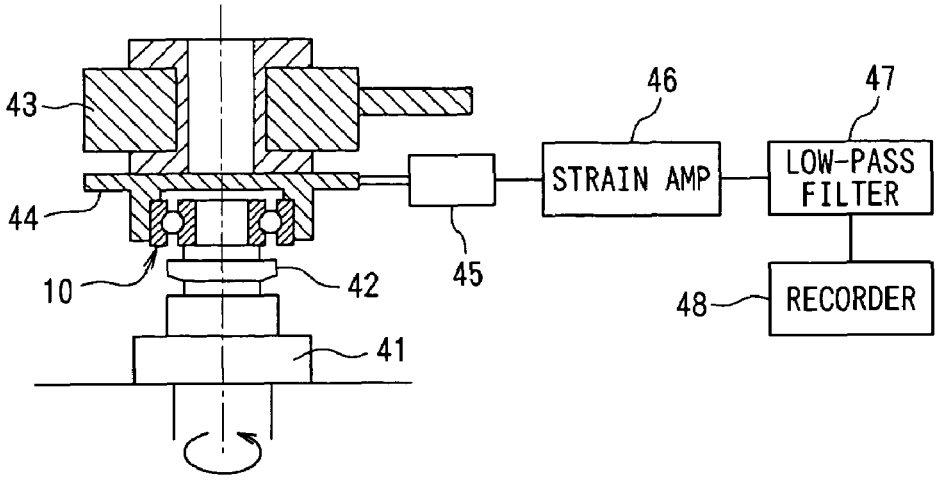
FIG. 3 is a schematic diagram showing the configuration of a torque measuring apparatus.

Method for Evaluating Torque Performance:

Using a torque measuring device shown in FIG. 3, the torque value of the ball bearing 10 was determined in the early stage of rotation. The inner ring of the ball bearing 10 was fixed to an air spindle 41 via an arbor 42, and the outer ring was fixed to an aluminum cap 44 which was equipped with an air bearing 43. The air spindle 41 was rotated at a rotational speed of 3,600 $min^{-1}$ at a room temperature so as to rotate the inner ring of the ball bearing 10. At the time when the torque value was almost stabilized (about 10 minutes later), the torque value was determined by a strain gauge 45 which was connected to the aluminum cap 44. The obtained value was recorded by a recorder 48 via a strain amp 46 and a low-pass filter 47.

The obtained results are also shown in Tables 1 to 3. In each table, when the torque value is 29.4 N·cm or less, it is evaluated as satisfactory and shown with the mark ○, and when the torque value is more than 29.4 N·cm, it is evaluated as unsatisfactory and shown with the mark x.

Figure 4:
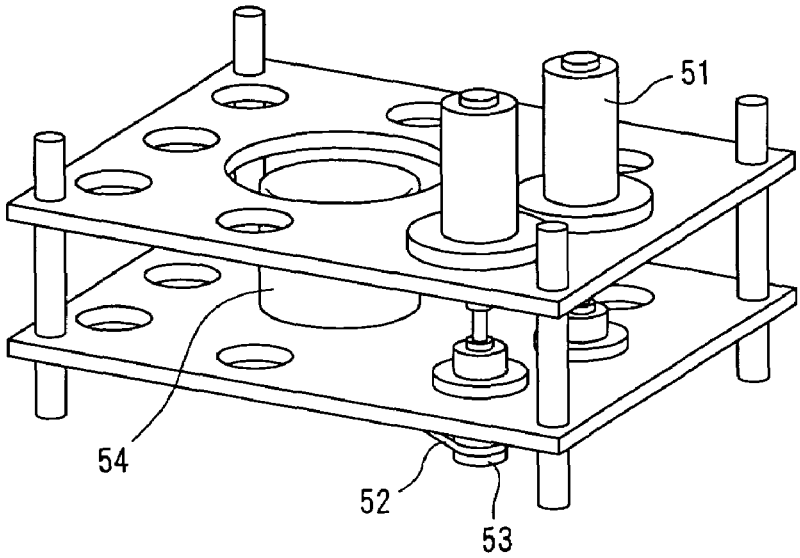
FIG. 4 is an oblique perspective view of a continuous rotating apparatus for evaluating the durability of a bearing.
Figure 5:
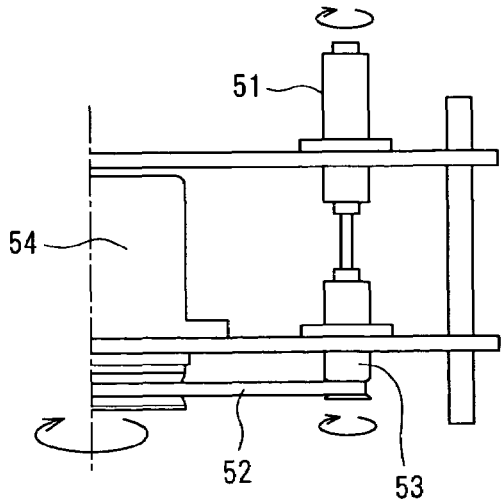
FIG. 5 is a partial front view of the continuous rotating apparatus of FIG. 4.

Method for Evaluating Durability:

The ball bearing 10 (not shown) was mounted in the housing 51 of a continuous rotating apparatus having a configuration shown in the oblique perspective view of FIG. 4 and the partial front view of FIG. 5, and rotated by a motor 54 via a rubber belt 52 and a pulley 53. The rotational speed was 3,600 $min^{1}$ and the test temperature was 70° C. The Anderon value of the ball bearing 10 was determined using an Anderon Meter every 500 hours of rotation, and the life was defined as a time when the Anderon value exceeded 2. However, where the Anderon value did not exceed 2 even after 3,000 hours, the test was terminated.

As well as the above described evaluation of acoustic durability, the evaluation of the amount of dusts generated from a grease composition was also carried out. That is, the amount of dusts generated from a grease composition at the time of the completion of the durability test (after rotation at a high temperature for a long time) was determined by the same method as described above.

The evaluation results of the durability and the amount of dusts generated from a grease composition after rotation at a high temperature for a long time are also shown in Tables 1 to 3. Where ">3,000" which is described in the column of durability means that the durability test was terminated after 3,000 hours of rotation.

Now, the results of each test will be considered. As apparent from Tables 1 to 3, the grease compositions in Examples A1 to A12 generated a small amount of dusts in the early stage of rotation both at an ordinary temperature and at a high temperature, and even when the grease compositions were subjected to rotation at a high temperature for a long time, the amount of dusts generated was not significantly increased. Further, their acoustic performance and torque value were excellent in the early stage of rotation, and also their durability was extremely excellent.

In contrast, since Comparative examples A1 and A2 did not comprise PTFE as a thickener, a large amount of dusts was generated in the initial rotation stage. Moreover, the amount of dusts generated further increased by rotation at a high temperature for a long time.

Comparative example A3 generated a small amount of dusts, but since it did not comprise a metallic soap as a thickener, the acoustic performance and torque value in the initial rotation stage were unsatisfactory, and durability was also insufficient.

Example A13 was excellent in the amount of dusts generated, acoustic performance and torque value in the initial rotation stage. However, since the amount of the mineral oil and the synthetic oil in the base oil was smaller than the case of the perfluoropolyether oil, it was somewhat poor in durability.

Example A14 had a small amount of dusts generated and good acoustic performance in the initial rotation stage, but since the worked penetration was small, the torque value in the initial rotation stage was unsatisfactory.

Example A15 had good acoustic performance, torque value in the initial rotation stage and durability, but since the worked penetration was large, it generated a large amount of dusts in the initial rotation stage both at an ordinary temperature and at a high temperature, and further, the amount of dusts significantly increased when rotated at a high temperature for a long time in comparison with the grease compositions in Examples A1 to A12.

Next, the ratio between a metallic soap and PTFE in a thickener was studied. That is to say, grease compositions were prepared by variously changing the ratio between the metallic soap and PTFE in the grease composition of Example A1, and the amount of dusts generated at 70° C. in the initial rotation stage and durability were evaluated by the same method as described above. The results are shown in the graph of FIG. 6.

Figure 6:
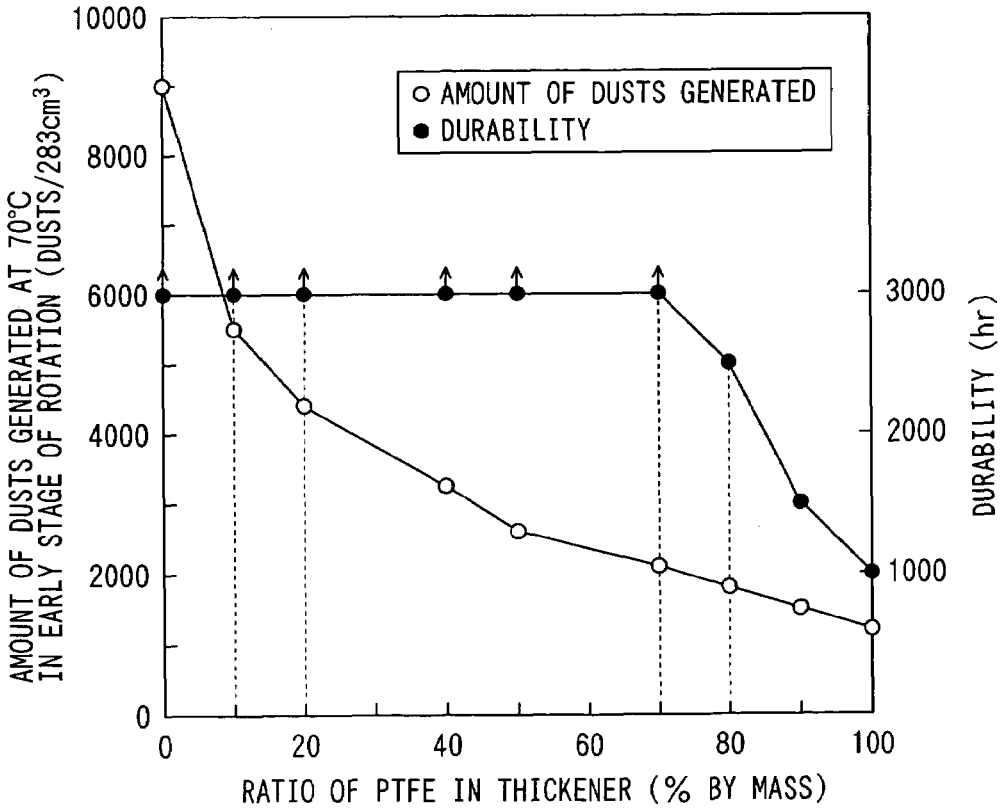
FIG. 6 is a graph showing the correlation between the ratio of PTFE in a thickener, and the amount of dusts generated and durability of a grease composition, in the case of using a grease composition comprising a metallic soap as the second thickener component.

The graph of FIG. 6 shows that when the ratio of PTFE in a thickener was 10 to 80% by mass, the grease composition was excellent in both the amount of dusts generated at 70° C. in the initial rotation stage and durability, and when the ratio was 20 to 70% by mass, the above both performances were more excellent.

Next, the content of a thickener based on the total mass of a grease composition was studied. That is to say, grease compositions were prepared by variously changing the content of the thickener in the grease composition of Example A1, and the amount of dusts generated at 70° C. in the initial rotation stage and durability were evaluated by the same method as described above. The results are shown in the graph of FIG. 7.

Figure 7:
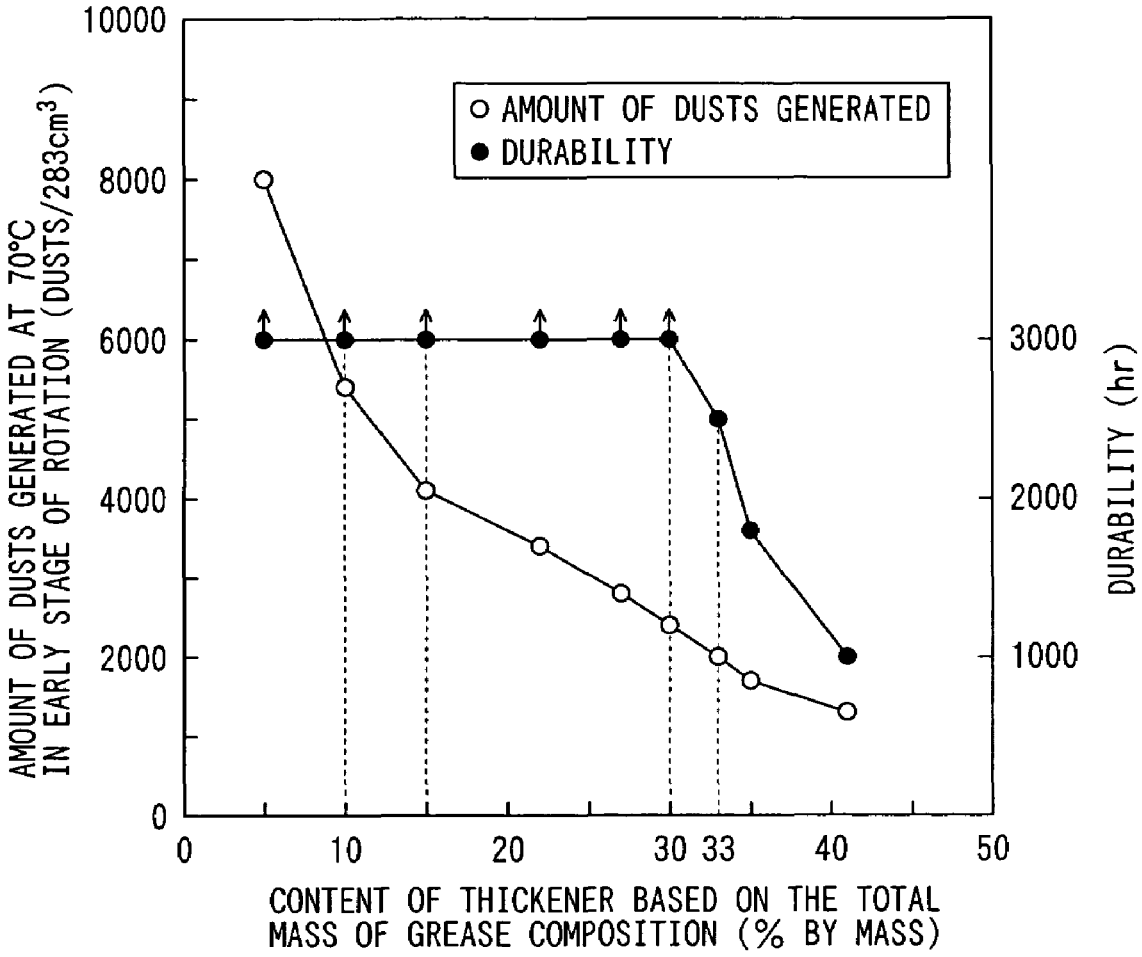
FIG. 7 is a graph showing the correlation between the content of a thickener based on the total mass of a grease composition, and the amount of dusts generated and durability of the grease composition, in the case of using a grease composition comprising a metallic soap as the second thickener component.

The graph of FIG. 7 shows that when the content of the thickener was 10 to 33% by mass, the grease composition was excellent in both the amount of dusts generated at 70° C. in the initial rotation stage and durability, and when the content was 15 to 30% by mass, the above both performances were more excellent.

Figure 8:
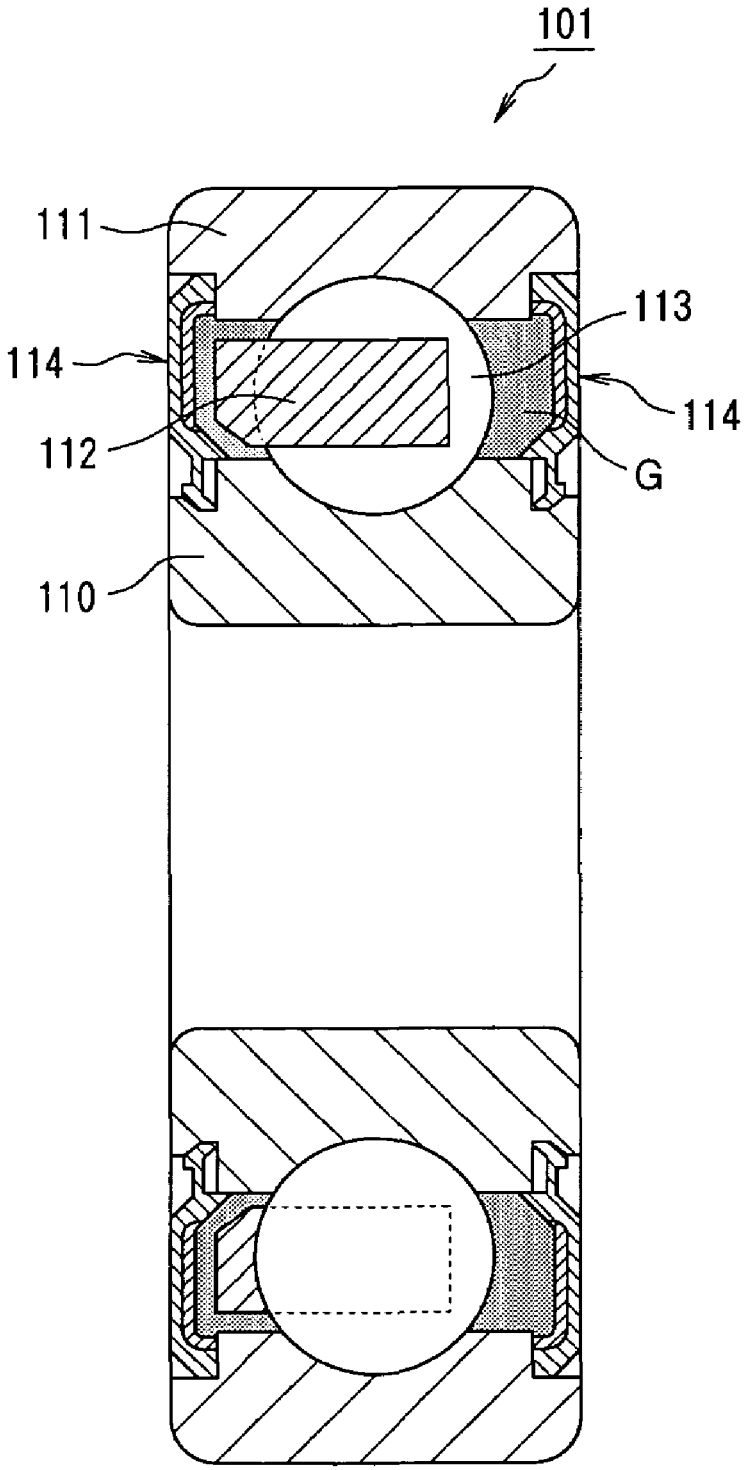
FIG. 8 is a longitudinal sectional view showing the configuration of a ball bearing, which is another embodiment of the rolling apparatus of the present invention.

(B) Grease composition comprising fluoro resin and N-substituted terephthalamic acid metal salt as thickener FIG. 8 is a longitudinal sectional view showing the configuration of a ball bearing 101, which is one embodiment of the rolling apparatus of the present invention. This ball bearing 101 is comprised of an inner ring 110; an outer ring 111; a plurality of balls 113, which are disposed between the inner ring 110 and the outer ring 111 so as to flexibly roll therebetween; a cage 112 for retaining the plurality of balls 113; and contact seals 114,114 installed in the outer ring 111. A space portion, which is surrounded by the inner ring 110, the outer ring 111 and the seals 114,114, is filled with a grease composition G, and the seal 114 hermetically sealed the grease composition in the ball bearing 101. This grease composition G lubricates the contact surface between the raceway surfaces of both rings 110 and 111, and the balls 113.

The grease composition G comprises 20% by mass of a thickener and 80% by mass of a base oil. The thickener comprises 50% by mass of an N-substituted terephthalamic acid metal salt and 50% by mass of PTFE, and the base oil comprises 50% by mass of a polyol ester oil and 50% by mass of a perfluoropolyether oil (PFPE oil). Since the grease composition G comprises the PTFE and the PFPE oil, it has excellent heat resistance.

Since a rolling apparatus such as a ball bearing filled with this grease composition has excellent lubricating ability and is long-lived under high temperature conditions, it can preferably be used as a rolling or sliding portion of machines used under high-temperature and high-speed conditions including car electrical components such as alternators or electromagnetic clutches; auxiliary equipment for car engine such as idler pulleys; and business machines such as copying machines or printers.

Next, with regard to 18 types of grease compositions (Examples B1 to B12, and Comparative Examples B1 to B6)

which have almost the same composition as the above described grease composition G, a worked penetration determination, a rust protection test, a copper corrosion test, a seizure test and a grease leakage test were carried out.

The compositions of the grease compositions of Examples B1 to B12 and Comparative examples B1 to B6 are as shown in Tables 4 to 6, and each grease composition comprises a thickener consisting of N-octadecyl terephthalamic acid metal salt (sodium salt or barium salt) and a fluoro resin (PTFE or a copolymer), and a base oil consisting of a synthetic oil and a PFPE oil (excluding Comparative examples B1 and B2). Each grease composition further comprises, as additives, 1.0% by mass of an amine antioxidant, 0.5% by mass of a calcium sulfonate rust preventive and 0.05% by mass of a benzotriazole metal deactivator based on the total mass of the grease composition.

TABLE 4

| | Example B1 | Example B2 | Example B3 | Example B4 | Example B5 | Example B6 |
|---|---|---|---|---|---|---|
| Type of thickener[1)] | | | | | | |
| Terephthalamic acid Na[2)] | 50 | — | 20 | 50 | 60 | — |
| Terephthalamic acid Ba[3)] | — | 50 | — | — | — | 50 |
| PTFE | 50 | 50 | 80 | — | — | — |
| Copolymer[4)] | — | — | — | 50 | 40 | 50 |
| Content of thickener[1)] | 25 | 25 | 30 | 25 | 24 | 25 |
| Type of base oils[1)] | | | | | | |
| POE oil[5)] | 50 | 50 | 20 | 50 | 60 | 50 |
| ADPE oil[5)] | — | — | — | — | — | — |
| PFPE oil | 50 | 50 | 80 | 50 | 40 | 50 |
| Content of base oil[1)] | 75 | 75 | 70 | 75 | 76 | 75 |
| Worked penetration | 268 | 275 | 270 | 273 | 272 | 279 |
| Copper corrosion test | 1 | 1 | 1 | 1 | 1 | 1 |
| Rust protection test | #6 | #6 | #5 | #6 | #6 | #6 |
| Seizure test (for life)[7)] | 1274 | 1199 | 1612 | 1231 | 1098 | 1167 |
| Grease leakage test[1)] | 3.5 | 3.6 | 2.8 | 3.4 | 3.5 | 3.5 |

[1)]Unit is % by mass
[2)]N-octadecylterephthalamic acid sodium salt
[3)]N-octadecylterephthalamic acid barium salt
[4)]Copolymer of vinylidene fluoride and hexafluoroisobutylene (molar ratio 1:1)
[5)]Polyol ester oil
[6)]Alkyl diphenyl ether oil
[7)]Unit is hr

TABLE 5

| | Example B7 | Example B8 | Example B9 | Example B10 | Example B11 | Example B12 |
|---|---|---|---|---|---|---|
| Type of thickener[1)] | | | | | | |
| Terephthalamic acid Na[2)] | 50 | — | 20 | 50 | 60 | — |
| Terephthalamic acid Ba[3)] | — | 50 | — | — | — | 50 |
| PTFE | 50 | 50 | 80 | — | — | — |
| Copolymer[4)] | — | — | — | 50 | 40 | 50 |
| Content of thickener[1)] | 25 | 25 | 30 | 25 | 24 | 25 |
| Type of base oils[1)] | | | | | | |
| POE oil[5)] | — | — | — | — | — | — |
| ADPE oil[6)] | .50 | 50 | 20 | 50 | 60 | 50 |
| PFPE oil | 50 | 50 | 80 | 50 | 40 | 50 |
| Content of base oil[1)] | 75 | 75 | 70 | 75 | 76 | 75 |
| Worked penetration | 268 | 275 | 270 | 273 | 272 | 279 |
| Copper corrosion test | 1 | 1 | 1 | 1 | 1 | 1 |
| Rust protection test | #6 | #6 | #5 | #6 | #6 | #6 |
| Seizure test (for life)[7)] | 1688 | 1632 | 1722 | 1595 | 1534 | 1521 |
| Grease leakage test[1)] | 3.5 | 3.4 | 2.8 | 3.4 | 3.5 | 3.5 |

[1)]Unit is % by mass
[2)]N-octadecylterephthalamic acid sodium salt
[3)]N-octadecylterephthalamic acid barium salt
[4)]Copolymer of vinylidene fluoride and hexafluoroisobutylene (molar ratio 1:1)
[5)]Polyol ester oil
[6)]Alkyl diphenyl ether oil
[7)]Unit is hr

TABLE 6

| | Comparative example B1 | Comparative example B2 | Comparative example B3 | Comparative example B4 | Comparative example B5 | Comparative example B6 |
|---|---|---|---|---|---|---|
| Type of thickener[1)] | | | | | | |
| Terephthalamic acid Na[2)] | — | 100 | 50 | 80 | 70 | — |
| Terephthalamic acid Ba[3)] | — | — | — | — | — | 50 |
| PTFE | 100 | — | 50 | — | — | — |
| Copolymer[4)] | — | — | — | 20 | 30 | 50 |
| Content of thickener[1)] | 35 | 15 | 3 | 20 | 23 | 42 |
| Type of base oils[1)] | | | | | | |
| POE oil[5)] | — | — | — | — | — | — |
| ADPE oil[5)] | — | 100 | 50 | 80 | 70 | 50 |
| PFPE oil | 100 | — | 50 | 20 | 30 | 50 |
| Content of base oil[1)] | 65 | 85 | 97 | 80 | 77 | 58 |
| Worked penetration | 293 | 267 | — | 271 | 272 | 190 |
| Copper corrosion test | 4 | 1 | — | 1 | 1 | 1 |
| Rust protection test | #1 | #7 | — | #7 | #6 | #6 |
| Seizure test (for life)[7)] | 1743 | 375 | — | 737 | 891 | 689 |
| Grease leakage test[1)] | 2.3 | 4.5 | — | 3.9 | 3.6 | 1.1 |

[1)]Unit is % by mass
[2)]N-octadecylterephthalamic acid sodium salt
[3)]N-octadecylterephthalamic acid barium salt
[4)]Copolymer of vinylidene fluoride and hexafluoroisobutylene (molar ratio 1:1)
[5)]Polyol ester oil
[6)]Alkyl diphenyl ether oil
[7)]Unit is hr It should be noted that the contents of the base oil and the thickener described in Tables 4 to 6 are values based on the total mass of the base oil and the thickener defined as 100, and therefore the above additives are not considered. Values described in the columns of the type of thickener and the type of base oil represent mass ratio (% by mass) of each component based on the total mass of the thickener and the total mass of the base oil.

Each component of the grease composition will be explained below.

Copolymer: a copolymer of vinylidene fluoride and hexafluoroisobutylene (the mole ratio being 1:1)

Polyol ester oil: a kinematic viscosity at 40° C. being 70 $mm^2/S$

Alkyl diphenyl ether oil: a kinematic viscosity at 40° C. being

PFPE oil: a kinematic viscosity at 40° C. being 190 $mm^2/s$

Next, each test method and test results will be explained below.

Worked Penetration Determination:

Worked penetration was determined according to JIS K2220.

The results are shown in Tables 4 to 6. The grease compositions in Examples B1 to B12 had good worked penetration. In contrast, since the content of the thickener was too large in Comparative example B6, the worked penetration was small. Moreover, since the content of the thickener is too small in Comparative example B3, the grease composition did not become a grease state.

Rust Protection Test:

Each of the grease compositions in Examples B1 to B12 and Comparative examples B1 to B6 was filled in a deep groove ball bearing with rubber seals having an inside diameter of 17 mm, an outside diameter of 47 mm and a width of 14 mm (having the same configuration as the ball bearing of FIG. 8,) at 50% the volume of the space portion of the ball bearing.

After a running-in (rotation) at a rotational speed of 1,800 $min^{-1}$ for 30 seconds, 0.5 ml of 0.5% by mass of salt water was poured in the inside of the bearing, and another running-in was carried out again at a rotational speed of 1,800 $min^{-1}$ for 30 seconds. Then, this ball bearing was left at rest for 48 hours in a constant temperature and humidity bath which was controlled at 80° C. and 100% RH, and thereafter, the ball bearing was decomposed and the condition of rust generated on the raceway surface was observed by the visual test. The rust condition was evaluated in the following ranks.

#7: Generation of no rust

#6: Generation of very slight rust stain

#5: Generation of punctated rust with a diameter of 0.3 mm or shorter

#4: Generation of rust with a diameter of 1.0 mm or shorter

#3: Generation of rust with a diameter of 5.0 mm or shorter

#2: Generation of rust with a diameter of 10.0 mm or shorter

#1: Generation of rust on almost the entire surface of the raceway surface

Herein, #7 to #5 were defined as good rust protection, and #4 to #1 were defined insufficient rust protection.

The results are shown in Tables 4 to 6. The grease compositions in Examples B1 to B12 showed good rust protection. Accordingly, the grease compositions in Examples B1 to B12 can preferably be used in a bearing, which is used under strict environment where the bearing readily contacts with rain water or the like and so readily generates rust. In contrast, since Comparative example B1 does not contain a mineral oil or synthetic oil (that is, since it is a common fluoro grease), the rust protection was insufficient.

Copper Corrosion Test:

Copper corrosion test was carried out according to the method for a copper corrosion test with grease according to JIS K2220. The test temperature was set at 100° C., and after 24 hours, the condition of color change of a copper plate was observed by the visual test. According to the color change standard for copper plates, the condition was evaluated in 4 stages of class 1 to class 4 in which 1 is the best.

The results are shown in Tables 4 to 6. The color of copper plates was little changed with the grease compositions in Examples B1 to B12. In contrast, since Comparative example B1 does not contain a mineral oil or synthetic oil (that is, since it is a common fluoro grease), the color change of copper plates was observed.

Seizure Test:

Each of the grease compositions in Examples B1 to B12 and Comparative examples B1 to B6 was filled in a deep groove ball bearing with an iron shield having an inside diameter of 8 mm, an outside diameter of 22 mm and a width of 7 mm (having almost the same structure of the ball bearing of FIG. 8 with the exception that it comprises an iron shield instead of contact seals) at 50% the volume of the space portion of the ball bearing. Thereafter, the ball bearing was mounted to a tester which was similar to the bearing life tester of ASTM D 1741 shown in FIG. 9.

Thereafter, the ball bearing was rotated at a rotational speed of 3,000 $min^{-1}$ under conditions of a bearing temperature of 180° C. and an axial load of 59 N (other conditions were set in accordance with ASTM D 1741.) The life was defined as a time when seizure generated and the temperature of the outer ring was risen to 190° C. or higher. When the temperature was not risen to 190° C. or higher even after rotation for 1,000 hours, it was evaluated as satisfactory and the test was terminated. In this rotation test, 4 bearings were used for one type of bearing, and the mean value was defined as a test result.

The results are shown in Tables 4 to 6. The grease compositions in Examples B1 to B12 had good life. In contrast, since Comparative example B2 did not contain a fluoro resin and a PFPE oil (that is, since it is a common N-substituted terephthalamic acid metal salt grease), the anti-seizuring ability at a high temperature of this grease composition was poor. Moreover, since the contents of the fluoro resin and the PFPE oil were small in Comparative examples B4 and B5, the anti-seizuring ability at a high temperature of these grease compositions was insufficient.

Grease Leakage Test:

Each of the grease compositions in Examples B1 to B12 and Comparative examples B1 to B6 was filled in a deep groove ball bearing with rubber seals having an inside diameter of 17 mm, an outside diameter of 40 mm and a width of 12 mm (having the same configuration as the ball bearing of FIG. 8), at 35% the volume of the space portion of the ball bearing. Then, the inner ring was rotated at a rotational speed of 14,500 $min^{-1}$ for 20 hours under conditions of an outer ring temperature of 180° C. and an axial load of 200 N, the mass of the grease composition leaked from the bearing during rotation was measured.

When the amount of grease leaked was 10% or less by mass based on the total mass of the filled grease composition, it was evaluated as satisfactory. In this test, 4 bearings were used for one type of bearing, and the mean value was defined as a test result.

The test results are shown in Tables 4 to 6. The leaked amount of each of the grease compositions in Examples B1 to B12 was small, and therefore all these grease compositions were evaluated as satisfactory.

Figure 10:
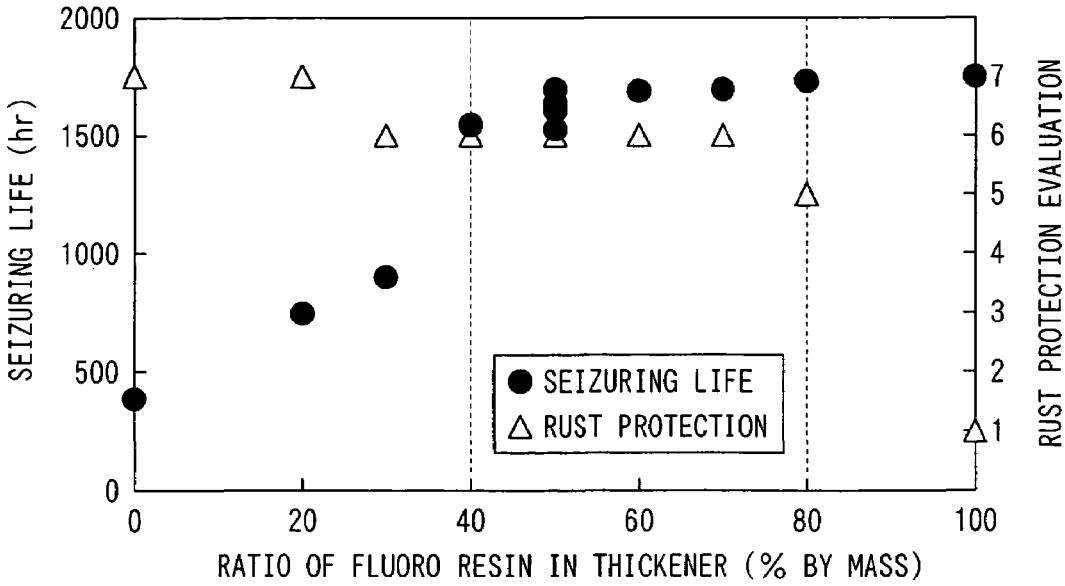
FIG. 10 is a graph showing the correlation between the ratio of a fluoro resin in a thickener, and the seizuring life of a ball bearing and the rust protection of a grease composition, in the case of using a grease composition comprising an N-substituted terephthalamic acid metal salt as the second thickener component.
Figure 11:
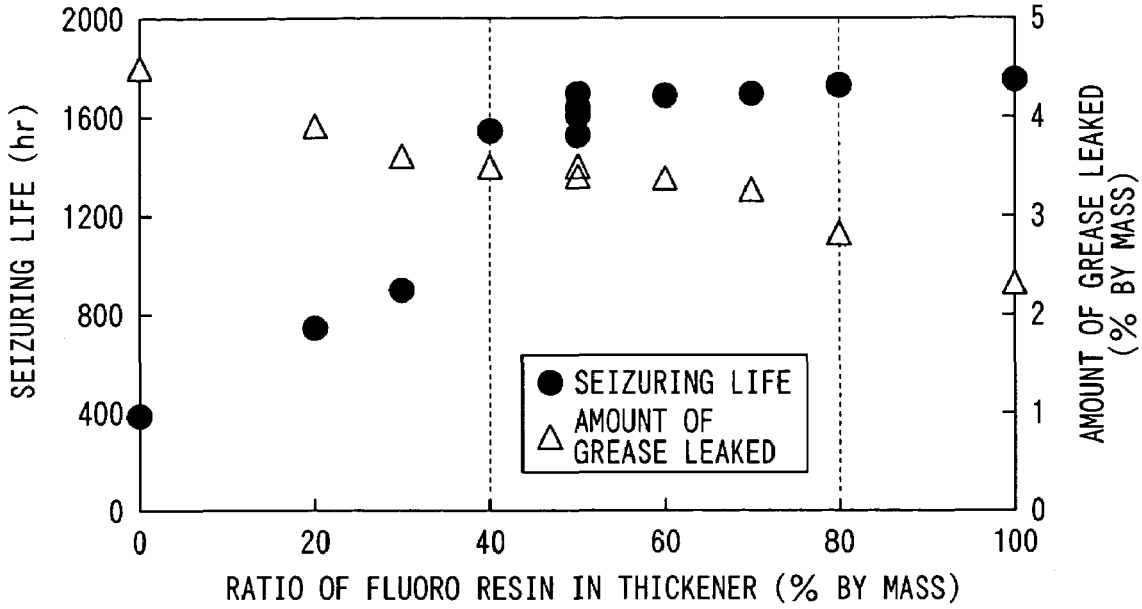
FIG. 11 is a graph showing the correlation between the ratio of a fluoro resin in a thickener, and the seizuring life of a ball bearing and the amount of grease leaked, in the case of using a grease composition comprising an N-substituted terephthalamic acid metal salt as the second thickener component.

FIG. 10 and FIG. 11 are graphs showing the results of the rust protection test, seizure test and grease leakage test, which were carried out on the grease compositions in Examples B7 to B12 and Comparative examples B1, B2, B4 and B5. The horizontal axis of each graph represents the ratio of the fluoro resin (PTFE or a copolymer) in the thickener.

As is clear from these graphs, when the ratio of the fluoro resin in the thickener was 40 to 80% by mass (that is, the ratio of the N-substituted terephthalamic acid metal salt being 60 to 20% by mass), both the rust protection and the seizuring life were excellent, and the amount of grease leaked was small.

(C) Grease composition comprising fluoro resin and organic bentonite as thickener A grease composition comprising a fluoro resin (PTFE) and organic bentonite as thickener was produced. When the fluoro resin is used as a thickener, it is desired to use a fluoro oil such as a perfluoropolyether oil (PFPE oil) as a base oil. A mixed base oil of a base oil other than a fluoro oil and the fluoro oil was used, and the mixing ratio is preferably a mass ratio which depends on the mass ratio between the fluoro resin and the organic bentonite.

The compositions of the grease compositions are as shown in Tables 7 and 8. It should be noted that the each value described in the column of "Type of thickeners" in Tables 7 and 8 is the mass ratio of each component which constitutes., the thickener, when the total mass of the thickener is defined as 100. Each value described in the column of "Type of base oils" has the same meaning. Moreover, values described in the columns of "Content of thickeners," "Content of base oils," and "Content of additives" are the mass ratio of each of thickeners, base oils and additives, in a case where the total mass of the grease composition is defined as 100.

TABLE 7

| | Example C1 | Example C2 | Example C3 | Example C4 |
|---|---|---|---|---|
| Type of thickener[1)] | | | | |
| Organic bentonite | 50 | 80 | 30 | 10 |
| PTFE | 50 | 20 | 70 | 90 |
| Content of thickener[1)] | 25 | 21 | 29 | 33 |
| Type of base oils[1)] | | | | |
| Paraffin mineral oil | 50 | — | — | 10 |
| PAO oil[2)] | — | 80 | — | — |
| PETE oil[3)] | — | — | 30 | — |
| Fluoro oil | 50 | 20 | 70 | 90 |
| Content of base oil[1)] | 71.5 | 75.5 | 67.5 | 63.5 |
| Content of additive[1)] | | | | |
| Naphtylamine[4)] | 1 | 1 | 1 | 1 |
| Calcium sulfonate | 0.5 | 0.5 | 0.5 | 0.5 |
| Sodium nitrite | 2 | 2 | 2 | 2 |
| Worked penetration | 345 | 322 | 355 | 376 |
| Water washout resistance (% by mass) | −1.2 | −1.3 | −1.0 | −0.9 |
| Rust protection property | ○ | ○ | ○ | ○ |
| Seizure load (N) | 1333 | 1333 | 1333 | 1333 |
| Lubricating life | 1.6 | 2.2 | 2.3 | 1.8 |

[1)]Unit is % by mass
[2)]Poly α-olefin oil
[3)]Pentaerythritol tetraester oil
[4)]Phenyl-α-naphthylamine

TABLE 8

| | Comparative example C1 | Comparative example C2 | Comparative example C3 | Comparative example C4 |
|---|---|---|---|---|
| Type of thickener[1)] | | | | |
| Organic bentonite | 100 | — | — | — |
| PTFE. | — | 100 | — | — |
| Content of thickener[1)] | 18 | 35 | — | — |
| Type of base oils[1)] | | | | |
| Paraffin mineral oil | 35 | — | — | — |
| PAO oil[2)] | 65 | — | — | — |
| PETE oil[3)] | — | — | — | — |
| Fluoro oil | — | 100 | — | — |
| Content of base oil[1)] | 80.5 | 63 | — | — |
| Content of additive[1)] | | | | |
| Naphtylamine[4)] | 1 | — | — | — |
| Calcium sulfonate | 0.5 | — | — | — |
| Sodium nitrite | — | 2 | — | — |
| Worked penetration | 312 | 290 | 271 | 285 |
| Water washout resistance (% by mass) | −3.7 | −0.6 | −0.7 | −0.7 |
| Rust protection property | x | ○ | ○ | x |
| Seizure load (N) | 980 | 980 | 980 | 980 |
| Lubricating life | 1.0 | 2.5 | 1.6 | 1.9 |

[1)]Unit is % by mass
[2)]Poly α-olefin oil
[3)]Pentaerythritol tetraester oil
[4)]Phenyl-α-naphthylamine A method of producing a grease composition comprising a fluoro resin as a thickener is not particularly limited, but a preferred example includes the method described in Japanese Patent Laid-Open No. 10-273684. The grease compositions in Comparative examples C1 and C2 are commercially available fluoro grease compositions.

With regard to these 8 types of grease compositions (Examples C1 to C4, and Comparative Examples C1 to C4), worked penetration and water washout resistance were determined (according to JIS K2220). In order to determine water washout resistance, a deep groove ball bearing of bearing designation 6204 was filled with 4 g of each type of grease composition, and the bearing was rotated at 600 $min^{-1}$ while distilled water with 79° C. was sprayed there on at a rate of 5 ml/s. After rotation for 1 hour, the reduced amount (% by mass) of the grease composition was defined as water washout resistance. The results are shown in Tables 7 and 8.

Moreover, the rust protection, load carring capacity and lubricating life of these grease compositions were also evaluated (refer to Tables 7 and 8 for the results). The evaluation methods will be explained below.

Rust Protection Test:

Each of the grease compositions in Examples C1 to C4 and Comparative examples C1 to C4 was filled in a deep groove ball bearing with rubber seals having an inside diameter of 17 mm, an outside diameter of 47 mm and a width of 14 mm (not shown) at 50% the volume of the space portion of the ball bearing.

After a running-in (rotation) at a rotational speed of 1,800 $min^{-1}$ for 30 seconds, 0.5 ml of salt water having a concentration of 0.5% by mass was poured in the inside of the bearing, and another running-in was carried out again at a rotational speed of 1,800 $min^{-1}$ for 30 seconds. Then, this ball bearing was left at rest for 48 hours in a constant temperature and humidity bath which was controlled at 80° C. and 100% RH, and thereafter, the ball bearing was decomposed and the condition of rust generated on the raceway surface was observed by the visual test. The rust condition was evaluated in the following ranks.

#7: Generation of no rust

#6: Generation of very slight rust stain

#5: Generation of punctated rust with a diameter of 0.3 mm or shorter

#4: Generation of rust with a diameter of 1.0 mm or shorter

#3: Generation of rust with a diameter of 5.0 mm or shorter

#2: Generation of rust with a diameter of 10.0 mm or shorter

#1: Generation of rust on almost the entire surface of the raceway surface

Herein, #7 to #5 were defined as good rust protection, and #4 to #1 were defined insufficient rust protection. In a graph described later, rust protection is represented by each of the above values, but in each table, good rust protection is represented by the symbol ○, and insufficient rust protection is represented by the symbol x.

Evaluation Method of Load Carring Capacity:

Load carrying capacity was evaluated by a four-ball test, using a four-ball tester based on ASTM. That is, 3 test balls (SUJ2 (the corresponding US Industrial Standard number SAE52100)steel balls for ball bearings having a diameter of abaout a half inch) were disposed and fixed in a regular triangle form so that the balls were contact with one another, and a test ball was then placed and held on a hollow, which was formed in the center of he balls.

An evaluation target, grease composition was applied on all the test balls, and the test ball which was placed and held as above was rotated at a certain rotational speed (4,000 $min^{-1}$) under load conditions. The above load was set at 98 N for 1 minute in the initial rotation stage, and then the load was gradually increased at a rate of 392 N per minute. Seizure load was defined as a load at the time when rotation torque was sharply increased, and load carring capacity was evaluated with this seizure load.

Figure 9:
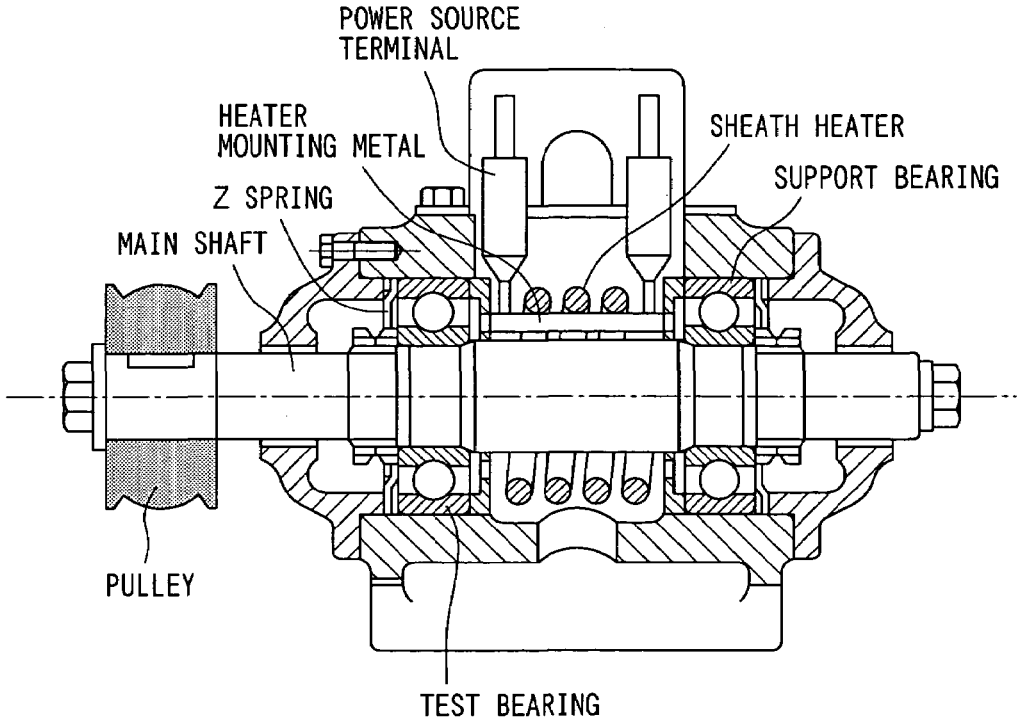
FIG. 9 is a cross-sectional view showing the configuration of a bearing life test machine for evaluating the seizuring ability of a grease composition.

Evaluation Method of Lubricating Life:

Each 5 g of the above 8 types of grease compositions was enclosed in a rolling bearing separately, and the rolling bearing was then mounted to a tester which was similar to the bearing life tester of ASTMD1741 shown in FIG. 9. Thereafter, the rolling bearing was rotated at a rotational speed of 1,000 $min^{-1}$ under conditions of a temperature of 150° C., a radial load of 98 N and an axial load of 294 N. Lubricating life was defined as a time when the motor stopped due to overload or a time when the temperature of the bearing exceeded 160° C.

This lubricating life is an $L_{50}$ life, which was obtained by examining 10 tests per one type of bearing and then using a Weibull distribution curve. The term "lubricating life" is not used herein to mean the rolling fatigue life of a bearing due to the generation of flaking, but the term is used herein to mean the life of a grease determined when a bearing becomes not to rotate because of the deterioration of a grease composition or the like.

The configuration of the rolling bearing used in the test will be explained below, while referring to a partial longitudinal sectional view in FIG. 1.

This rolling bearing (bearing designation 6306VV, inside diameter: 30 mm, outside diameter: 72 mm, width: 19 mm) is comprised of: an inner ring 1; an outer ring 2; a plurality of balls 3, which are disposed between the inner ring 1 and the outer ring 2 so as to flexibly roll therebetween; a cage 4 for retaining the plurality of balls 3 between the inner ring 1 and the outer ring 2; and noncontact rubber seals 5, 5.

The rubber seal 5 is attached to a seal groove 2*a* of the outer ring 2, and the seal covers almost the entire opening portion located between the outer surface of the inner ring 1 and the inner surface of the outer ring 2. A space portion, which is formed between the inner ring 1 and the outer ring 2 and in which the balls 3 were placed, is filled with a grease composition G, and the rubber seals 5, 5 hermetically seal the grease composition in the bearing. This rubber seal 5 may also be a contact type.

The test results are shown in Tables 7 and 8. The lubricating life is represented by a relative value in a case where the lubricating life of the grease composition in Comparative example C1 is defined as 1.

As understood from Tables 7 and 8, the grease compositions in Examples C1 to C4 were more excellent than the grease compositions in Comparative Examples C1 to C4 in terms of water washout resistance (water-resisting), rust protection and load carring capacity (extreme-pressure property). These grease compositions were excellent also in lubricating life, and the bearing was long-lived under high-temperature conditions.

Figure 12:
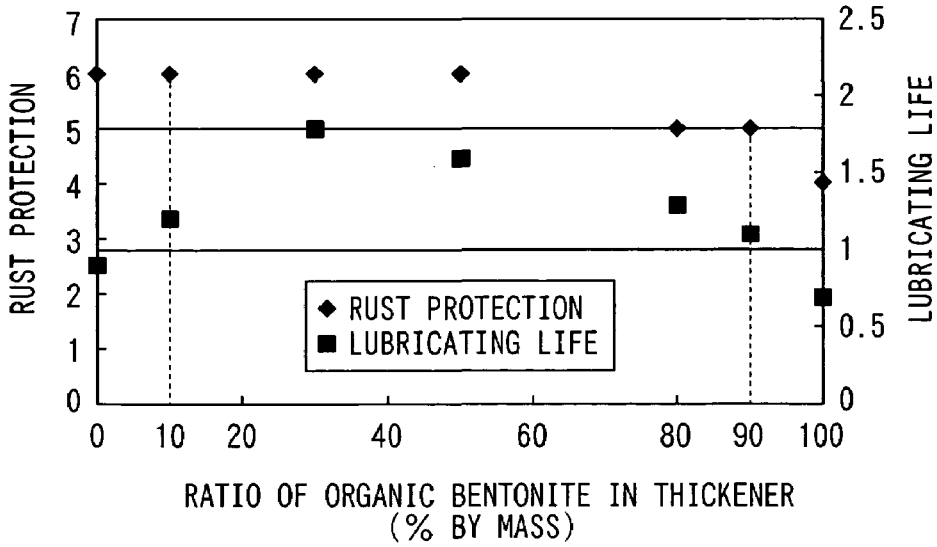
FIG. 12 is a graph showing the correlation between the ratio of organic bentonite in a thickener, and the rust protection and lubricating life of a grease composition, in the case of using a grease composition comprising organic bentonite as the second thickener component.

Next, grease compositions were prepared by diversely changing the ratio of organic bentonite to the total mass of the thickener in the grease composition of Example C1. Then, rust protection and lubricating life were evaluated by the same method as described above. The results are shown in the graph of FIG. 12. The lubricating life in the graph is represented by a relative value in a case where the lubricating life of the grease composition in Comparative example C1 is defined as 1. The graph shows that when the content of the organic bentonite is 10 to 90% by mass, the rust protection and the lubricating life are excellent.

Figure 13:
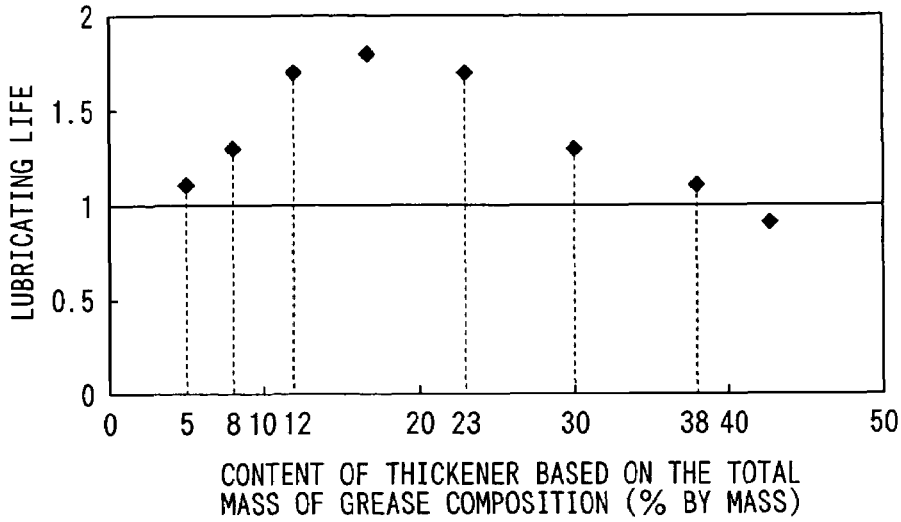
FIG. 13 is a graph showing the correlation between the content of a thickener based on the total mass of the grease composition and the lubricating life, in the case of a grease composition comprising organic bentonite as the second thickener component.

Moreover, grease compositions were prepared by diversely changing the content of thickener to the total mass of the grease composition in the grease composition of Example C1. Then, lubricating life was evaluated by the same method as described above. The results are shown in the graph of FIG. 13. The lubricating life in the graph is represented by a relative value in a case where the lubricating life of the grease composition in Comparative example C1 is defined as 1.

This graph shows that when the content of the thickener is 5 to 38% by mass based on the total mass of the grease composition, the lubricating life of the grease composition is excellent. The graph also shows that, when the content is 8 to 30% by mass, the lubricating life is more excellent, and when the content is 12 to 23% by mass, the lubricating life is further more excellent.

Figure 14:
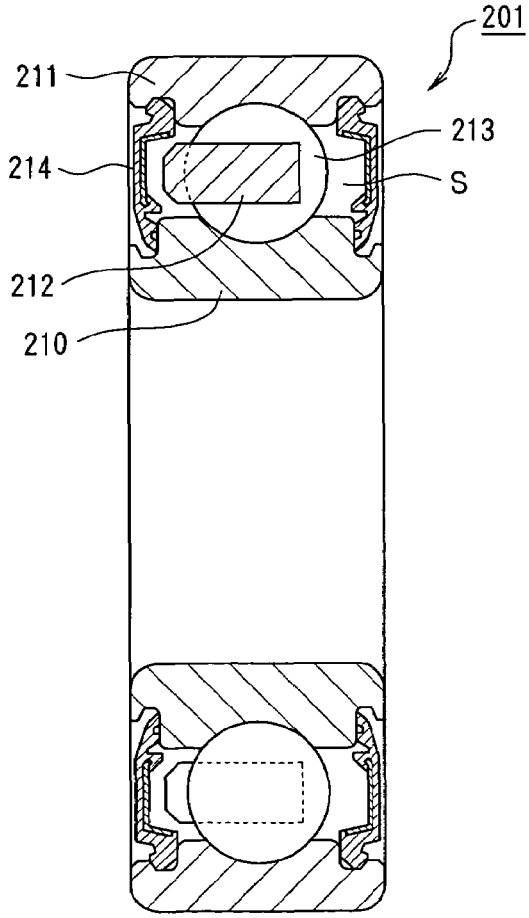
FIG. 14 is a longitudinal sectional view showing the configuration of a ball bearing, which is another embodiment of the rolling apparatus of the present invention.

(D) Grease composition comprising fluoro resin and calcium sulfonate complex as thickener The configuration of a rolling bearing filled with a grease composition comprising a fluoro resin and a calcium sulfonate complex as thickeners is not particularly limited, but an example includes the ball bearing shown in FIG. 14. The ball bearing 201, as illustrated in the figure, is comprised of an inner ring 210; an outer ring 211; a plurality of balls 213, which are disposed between the inner ring 210 and the outer ring 211 so as to flexibly roll therebetween; and a cage 212 for retaining the plurality of balls 213, wherein the space portion of the bearing S is filled with a grease composition described later, and a seal 214 seals the grease composition in the bearing.

The present invention is further described in the following examples and comparative examples. However, these examples are not intended to limit the scope of the invention.

Using base oils and thickeners as shown in Table 9, ten types of grease compositions (Examples D1 to D6 and Comparative examples D1 to D4) were prepared. The content of the thicker was set at 30% by mass in any of the grease compositions. Using these 10 types of grease compositions, each of the following tests was carried out. The results are shown in Table 9.

TABLE 9

| | Example D1 | Example D2 | Example D3 | Example D4 | Example D5 | Example D6 |
|---|---|---|---|---|---|---|
| Thickener A (mass ratio) | 50 | 20 | 5 | 50 | 80 | 95 |
| Thickener B (mass ratio) | 50 | 80 | 95 | 50 | 20 | 5 |

TABLE 9-continued

| | | | | | | |
|---|---|---|---|---|---|---|
| Base oil A (mass ratio) | ADE (50) | PET (20) | DPET (5) | ADE | DPET + MO | PAO |
| Base oil B (mass ratio) | PFPE (50) | PFPE (80) | PFPE (95) | — | — | — |
| Seizure load (N) | 1500 | 1280 | 1100 | 1580 | 1780 | 1700 |
| Lubricating life (hr) | 1780 | 1880 | 2000 | 1580 | 1540 | 1620 |
| Result of rust protection test | ○ | ○ | ○ | ○ | ○ | ○ |

| | Comparative example D1 | Comparative example D2 | Comparative example D3 | Comparative example D4 |
|---|---|---|---|---|
| Thickener A (mass ratio) | 100 | — | 3 | 97 |
| Thickener B (mass ratio) | — | 100 | 97 | 3 |
| Base oil A (mass ratio) | MO | — | PET (3) | PAO (97) |
| Base oil B (mass ratio) | — | PFPE | PFPE (97) | PFPE (3) |
| Seizure load (N) | 1820 | 1000 | 1000 | 1650 |
| Lubricating life (hr) | 1280 | 2180 | 2020 | 1420 |
| Result of rust protection test | ○ | x | Δ | ○ |

Thickener A: Calcium sulfonate complex
Thickener B: Polytetrafluoroethylene
PFPE: Perfluoropolyether
ADE: Alkyldiphenylether
PET: Pentaerythritol ester
DPET: Dipentaerythritol ester
PAO: Poly α-olefin
MO: Mineral oil Evaluation Method of Load Carring Capacity:

Load carrying capacity was evaluated by a four-ball test, using a four-ball tester based on ASTM. That is, 3 test balls (SUJ2 (the corresponding US Industrial Standard number SAE52100)steel balls for ball bearings having a diameter of abaout a half inch) were disposed and fixed in a regular triangle form so that the balls were contact with one another, and a test ball was then placed and held on a hollow, which was formed in the center of the three balls.

Thereafter, an evaluation target, grease composition was applied on all the test balls, and the test ball which was placed and held as above was rotated at a certain rotational speed (4,000 $min^{-1}$) under load conditions. The above load was gradually increased at a rate of 1,800 N per minute. Seizure load was defined as a load at the time when rotation torque was sharply increased. Load carring capacity was evaluated with this seizure load, and when the seizure load was 1,100. N or more, the grease composition was evaluated as satisfactory.

Evaluation Method of Lubricating Life:

Lubricating life was evaluated, using a tester similar to the bearing life tester of ASTM D 1741 shown in FIG. 9.

First, the space portion of a rolling bearing (bearing designation 6306VV) manufactured by NSK Ltd., was filled with a grease composition at 35% the volume of the space portion. Thereafter, the rolling bearing was mounted to the above tester, and the inner ring was then rotated at a rotational speed of 7,000 $min^{-1}$ under conditions of a temperature of 180° C., a radial load of 98 N and an axial load of 294 N. A cycle of rotating the inner ring for 24 hours and then stopping it for 4 hours was repeated. Lubricating life was defined as a time when the motor stopped due to overload or a time when the temperature of the bearing exceeded 190° C.

When the lubricating life was 1,500 hours or longer, the grease composition was evaluated as satisfactory.

Rust Protection Test:

The space portion of a rolling bearing (bearing designation 6202VV) manufactured by NSK Ltd., was filled with each of the grease compositions in Examples D1 to D6 and Comparative examples D1 to D4 at 35% the volume of the space portion.

Thereafter, under load conditions of an axial preload of 39.2 N, the rolling bearing was left for 1 month in a constant temperature and humidity bath, which was controlled at 80° C. and at 90% RH. At that time, the rolling bearing was placed in the constant temperature and humidity bath at an ordinary temperature without preheating it, so as to cause condensation on the rolling bearing. One month later, the rolling bearing was taken out of the constant temperature and humidity bath. The rolling bearing was then decomposed, and the condition of rust generated was visually observed. Rust protection was evaluated according to the following standard:

No rust: ○ (Satisfactory)

Punctated rust (1 to 3 spots): Δ (Unsatisfactory)

Punctated rust (many spots): x (Unsatisfactory)

As shown in Table 9, the rolling bearing of each Example filled with a grease composition which comprises, as a thickener, a calcium sulfonate complex consisting of calcium sulfonate and a calcium salt and a fluoro resin had a seizuring load which further exceeded 1,100 N as a satisfactory standard. Moreover, the rolling bearing of each Example had a lubricating life which further exceeded 1,500 hours as a satisfactory standard. Furthermore, in all the Examples, the rolling bearing passed the rust protection test.

In contrast, the lubricating life of the rolling bearing of Comparative example D1 did not reach the satisfactory standard. Moreover, the load carring capacity and the rust protection of the rolling bearings of Comparative examples D2 and D3 did not reach the satisfactory standard. Furthermore, the lubricating life of the rolling bearing of Comparative example D4 did not reach the satisfactory standard.

(E) Grease composition comprising fluoro resin and carbon black as thickener

Figure 15:
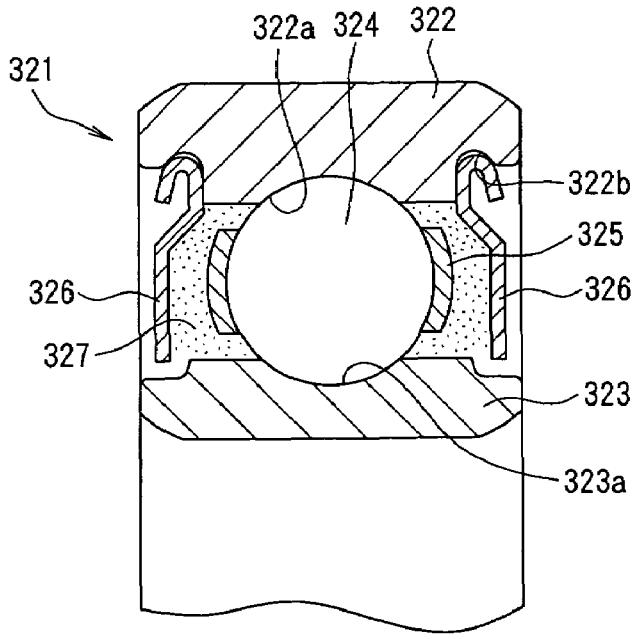
FIG. 15 is a partial longitudinal sectional view showing the configuration of a ball bearing, which is another embodiment of the rolling apparatus of the present invention.

FIG. 15 is a partial longitudinal sectional view showing the configuration of a ball bearing 321, which is one embodiment of the rolling apparatus of the present invention. This ball bearing 321 is comprised of: an outer ring 322; an inner ring 323; a plurality of balls 324, which are disposed between the outer ring 322 and the inner ring 323 so as to flexibly roll therebetween; a cage 325 for retaining the plurality of balls 324; and noncontact seals 326, 326 installed in the seal groove 322*b* of the outer ring 322. A space portion, which is surrounded by the outer ring 322, the inner ring 323 and the seals 326, 326 are filled with a grease composition 327, and the seal 326 hermetically sealed the grease composition 327 in the ball bearing 321.

This grease composition 327 comprises 20% by mass of a thickener and 80% by mass of a base oil. The thickener comprises 50% by mass of carbon black and 50% by mass of PTFE, and the base oil comprises 50% by mass of a poly α-olefin oil and 50% by mass of a perfluoropolyether oil (PFPE oil).

Since the grease composition 327 comprises carbon black, the grease composition 327 lubricates the contact surface between the raceway surfaces 322*a* and 323*a* of the above both rings 322 and 323, and the balls 324, and also conducts electricity to the outer ring 322, the inner ring 323 and the balls 324. In addition, the outer ring 322 or inner ring 323 is grounded (not shown in the figure), so that static electricity generated by the rotation of the ball bearing 321 can be eliminated. If the seal 326 is a contact type seal and is made from conductive rubber so that also the seal 326 obtains electric conductivity, the electric conductivity of the ball bearing 321 can be better.

Since the grease composition 327 comprises PTFE and a PFPE oil, this grease composition has excellent heat resistance.

A rolling apparatus such as a ball bearing filled with this grease composition has excellent electric conductivity and is long-lived under high temperature conditions, and therefore it can preferably be used as a rolling or sliding portion of machines used under high-temperature and high-speed conditions including car electrical components such as alternators or electromagnetic clutches; auxiliary equipment for car engine such as idler pulleys; and business machines such as copying machines or printers.

Next, with regard to 16 types of grease compositions (Examples E1 to E10, and Comparative Examples E1 to E6) which have almost the same composition as the above described grease composition 327, a worked penetration determination, a rust protection test, a copper corrosion test, a seizure test and an electric conductivity test were carried out.

The compositions of the grease compositions of Examples E1 to E10 and Comparative examples E1 to E6 are as shown in Tables 10 to 12, and each grease composition comprises a thickener consisting of carbon black and a fluoro resin (PTFE or a copolymer) and a base oil consisting of a synthetic oil and a PFPE oil (except Comparative examples E1 and E2). Each grease composition further comprises, as additives, 1.0% by mass of an amine antioxidant, 0.5% by mass of a calcium sulfonate rust preventive and 0.05% by mass of a benzotriazole metal deactivator based on the total mass of the grease composition.

TABLE 10

| | Example E1 | Example E2 | Example E3 | Example E4 | Example E5 |
|---|---|---|---|---|---|
| Type of thickener[1)] | | | | | |
| Carbon black | 50 | 60 | 20 | 50 | 60 |
| PTFE | 50 | 40 | 80 | — | — |
| Copolymer[2)] | — | — | — | 50 | 40 |
| Content of thickener[1)] | 20 | 18 | 28 | 20 | 18 |
| Type of base oils[1)] | | | | | |
| PAO oil[3)] | 50 | 73 | 21 | 50 | 52 |
| ADPE oil[4)] | — | — | — | — | — |
| PFPE oil | 50 | 27 | 79 | 50 | 48 |
| Content of base oil[1)] | 80 | 82 | 72 | 80 | 82 |
| Worked penetration | 278 | 280 | 270 | 273 | 272 |
| Copper corrosion test | 1 | 1 | 1 | 1 | 1 |
| Rust protection test | #6 | #6 | #5 | #6 | #6 |
| Seizure test (for life) | 1.9 | 1.9 | 2.3 | 2.0 | 1.8 |
| Electric conductivity test (for bearing's resistance) | 0.09 | 0.08 | 0.18 | 0.10 | 0.08 |

[1)]Unit is % by mass

[2)]Copolymer of vinylidene fluoride and hexafluoroisobutylene (molar ratio 1:1)

[3)]Poly α-olefin oil

[4)]Alkyldiphenylether oil

TABLE 11

| | Example E6 | Example E7 | Example E8 | Example E9 | Example E10 |
|---|---|---|---|---|---|
| Type of thickener[1)] | | | | | |
| Carbon black | 50 | 30 | 20 | 50 | 60 |
| PTFE | 50 | 70 | 80 | — | — |
| Copolymer[2)] | — | — | — | 50 | 40 |
| Content of thickener[1)] | 20 | 28 | 28 | 20 | 20 |
| Type of base oils[1)] | | | | | |
| PAO oil[3)] | — | — | — | — | — |
| ADPE oil[4)] | 38 | 28 | 20 | 50 | 50 |
| PFPE oil | 62 | 72 | 80 | 50 | 50 |
| Content of base oil[1)] | 80 | 72 | 72 | 80 | 80 |
| Worked penetration | 268 | 264 | 270 | 276 | 265 |
| Copper corrosion test | 1 | 1 | 1 | 1 | 1 |
| Rust protection test | #6 | #5 | #5 | #6 | #6 |
| Seizure test (for life) | 2.5 | 2.6 | 2.6 | 2.4 | 2.4 |
| Electric conductivity test (for bearing's resistance) | 0.13 | 0.24 | 0.25 | 0.15 | 0.10 |

[1)]Unit is % by mass
[2)]Copolymer of vinylidene fluoride and hexafluoroisobutylene (molar ratio 1:1)
[3)]Poly α-olefin oil
[4)]Alkyldiphenylether oil

TABLE 12

| | Comparative example E1 | Comparative example E2 | Comparative example E3 | Comparative example E4 | Comparative example E5 | Comparative example E6 |
|---|---|---|---|---|---|---|
| Type of thickener[1)] | | | | | | |
| Carbon black | — | 100 | 50 | 80 | 70 | 50 |
| PTFE | 100 | — | 50 | — | — | — |
| Copolymer[2)] | — | — | — | 20 | 30 | 50 |
| Content of thickener[1)] | 35 | 10 | 3 | 20 | 23 | 42 |
| Type of base oils[1)] | | | | | | |
| PAO oil[3)] | — | — | — | — | — | — |
| ADPE oil[4)] | — | 100 | 48 | 75 | 65 | 83 |
| PFPE oil | 100 | — | 52 | 25 | 35 | 17 |
| Content of base oil[1)] | 65 | 90 | 97 | 80 | 77 | 58 |
| Worked penetration | 293 | 267 | — | 271 | 272 | 190 |
| Copper corrosion test | 4 | 1 | — | 1 | 1 | 1 |
| Rust protection test | #1 | #7 | — | #6 | #6 | #6 |
| Seizure test (for life) | 2.8 | 1 | — | 1.2 | 1.3 | 1.2 |
| Electric conductivity test (for bearing's resistance) | 1.00 | 0.05 | — | 0.07 | 0.07 | 0.10 |

[1)]Unit is % by mass
[2)]Copolymer of vinylidene fluoride and hexafluoroisobutylene (molar ratio 1:1)
[3)]Poly α-olefin oil
[4)]Alkyldiphenylether oil It should be noted that the content of the base oil and the thickener described in each of Tables 10 to 12 is a value based on that the total mass of the base oil and the thickener is defined as 100, and that the above additives are not considered. Moreover, values described in the columns of the type of thickener and the type of base oil show the mass ratio (% by mass) of each component based on the total mass of the thickener and the total mass of the base oil.

Each component of the grease composition will be explained below.

Carbon black: a primary particle size of 30 nm, a DBP oil absorption with a dibutyl phthalate absorptiometer of 350 ml/100 g, and a specific surface area by nitrogen adsorption of 800 $m^2/g$ Copolymer: a copolymer of vinylidene fluoride and hexafluoroisobutylene (mole ratio being 1:1)

Poly α-olefin oil: a kinematic viscosity at 40° C. being 60 $mm^2/S$

Alkyl diphenyl ether oil: a kinematic viscosity at 40° C. being 100 $mm^2/s$

PFPE oil: a kinematic viscosity at 40° C. being 190 $mm^2/s$

Next, each test method and test results will be explained below.

Worked Penetration Determination:

Worked penetration was determined according to JIS K2220.

The results are shown in Tables 10 to 12. The grease compositions in Examples E1 to E10 had good worked penetration. In contrast, since the content of the thickener was too large in Comparative example E6, the worked penetration was small. Moreover, since the content of the thickener is too small in Comparative example E3, the grease composition did not become a grease state.

Rust Protection Test:

Each of the grease compositions in Examples E1 to E10 and Comparative examples E1 to E6 was filled in a deep groove ball bearing with rubber seals having an inside diameter of 17 mm, an outside diameter of 47 mm and a width of 14 mm (having almost the same configuration as the ball bearing of FIG. 8,) at 50% the volume of the space portion of the ball bearing.

After a running-in (rotation) at a rotational speed of 1,800 $min^{-1}$ for 30 seconds, 0.5 ml of 0.5% by mass of salt water was poured in the inside of the bearing, and another running-in was carried out again at a rotational speed of 1,800 $min^{-1}$ for 30 seconds. Then, this ball bearing was left at rest for 48 hours in a constant temperature and humidity bath which was controlled at 80° C. and 100% RH, and thereafter, the ball bearing was decomposed and the condition of rust generated on the raceway surface was observed by the visual test. The rust condition was evaluated in the following ranks:

#7: Generation of no rust

#6: Generation of very slight rust stain

#5: Generation of punctated rust with a diameter of 0.3 mm or shorter

#4: Generation of rust with a diameter of 11.0 mm or shorter

#3: Generation of rust with a diameter of 5.0 mm or shorter

#2: Generation of rust with a diameter of 10.0 mm or shorter

#1: Generation of rust on almost the entire surface of the raceway surface

Herein, #7 to #5 were defined as good rust protection, and #4 to #1 were defined insufficient rust protection.

The results are shown in Tables 10 to 12. The grease compositions in Examples E1 to E10 showed good rust protection. In contrast, since Comparative example E1 did not contain a mineral oil or synthetic oil (that is, since it is a common fluoro grease), the rust protection was insufficient.

Copper Corrosion Test:

Copper corrosion test was carried out according to the method for a copper corrosion test with grease according to JIS K2220. The test temperature was set at 100° C., and after 24 hours, the condition of color change of a copper plate was observed by the visual test. According to the color change standard for copper plates, the condition was evaluated in 4 stages of class 1 to class 4 in which 1 is the best.

The results are shown in Tables 10 to 12. The color of copper plates was little changed with the grease compositions in Examples E1 to E10. In contrast, since Comparative example E1 did not contain a mineral oil or synthetic oil (that is, since it is a common fluoro grease), the color change of copper plates was observed.

Seizure Test:

Each of the grease compositions in Examples E1 to E10 and Comparative examples E1 to E6 was filled in a deep groove ball bearing with an iron shield having an inside diameter of 8 mm, an outside diameter of 22 mm and a width of 7 mm (having the same configuration of the ball bearing of FIG. 15) at 50% the volume of the space portion of the ball bearing. Thereafter, the ball bearing was mounted to a tester which was similar to the bearing life tester of ASTM D 1741 shown in FIG. 9.

Thereafter, the ball bearing was rotated at a rotational speed of 3,000 $min^{-1}$ under conditions of a bearing temperature of 180° C. and an axial load of 59 N (other conditions were set in accordance with ASTM D 1741.) The life was defined as a time when seizure generated and the temperature of the outer ring was risen to 190° C. or higher. When the temperature was not risen to 190° C. or higher even after rotation for 1,000 hours, it was evaluated as satisfactory and the test was terminated. In this rotation test, 4 bearings were used for one type of bearing, and the mean value was defined as a test result.

The results are shown in Tables 10 to 12. The life described in each of Tables 10 to 12 is a relative value in a case where the life of Comparative example E2 is defined as 1. The grease compositions in Examples E1 to E10 had good life. In contrast, since Comparative example E2 did not contain a fluoro resin and a PFPE oil (that is, since it is a common carbon black grease), the anti-seizuring ability at a high temperature was poor. Moreover, since the contents of the fluoro resin and the PFPE oil were small in Comparative examples E4 and E5, the anti-seizuring ability at a high temperature of these grease compositions was insufficient.

Figure 16:
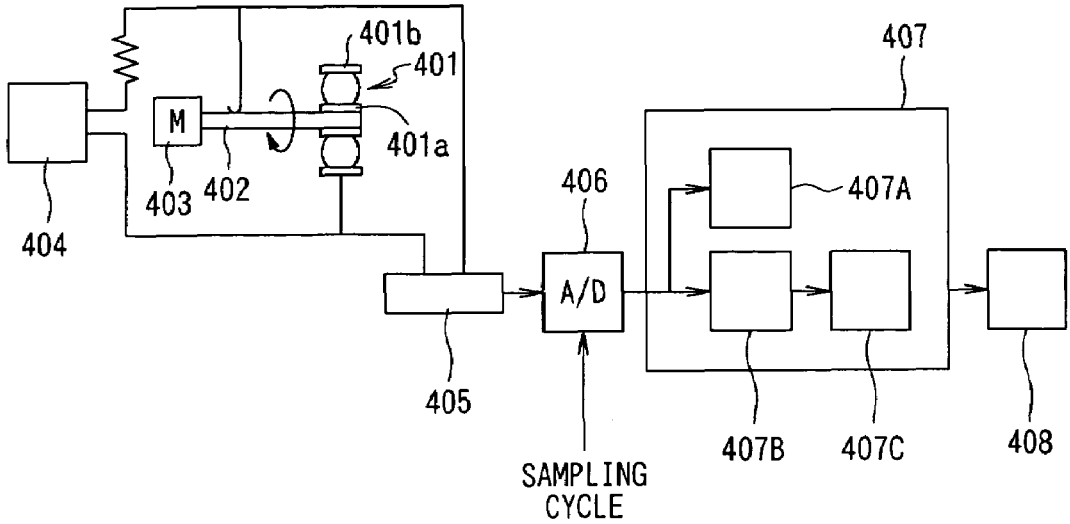
FIG. 16 is a schematic block diagram of an apparatus for measuring the electric resistance value of a bearing.

Electric Conductivity Test:

Each of the grease compositions in Examples E1 to E10 and Comparative examples E1 to E6 were filled in a ball bearing having the same configuration as in FIG. 15 at 50% the volume of the space portion of the bearing, and the ball bearing was then mounted to an apparatus shown in FIG. 16. Thereafter, electric resistance (maximum) between the inner ring and the outer ring during rotation was measured. The ball bearing was first rotated for 100 hours under the conditions of the above seizure test, and it was then subjected to this electric conductivity test.

First, the apparatus for measuring resistance will be explained, referring to the schematic block diagram of FIG. 16.

In FIG. 16, a numerical code 401 denotes a ball bearing that is a measurement target, and the apparatus is configured that a motor 403 rotates a shaft 402 installed in the inner ring 401*a*, so that the ball bearing 401 rotates. A certain constant voltage is applied between the shaft 402 installed in the inner ring 401*a* and an outer ring 401*b* by a constant-voltage power supply 404. An electric resistance measuring device 405 is connected in parallel to the constant-voltage power supply 404.

The electric resistance measuring device 405 outputs a measured voltage value (an analog value) to an A/D conversion circuit 406. The A/D conversion circuit 406 converts the measured voltage value to a digital value based on a previously established sampling cycle, and then it outputs the converted digital signal to a processor 407. In the present embodiment, the sampling cycle is set at 50 kHz (sampling time interval=0.02 ms).

The processor 407 is comprised of a maximum resistance processing unit 407A, a threshold processing unit 407B, and a wave number counting unit 407C. The maximum resistance processing unit 407A calculates the maximum resistance based on the input digital signal. The threshold processing unit 407B processes the input digital signal with a certain threshold value so as to eliminate noise. The wave number counting unit 407C counts the fluctuation number per certain time unit, that is, the wave number of waves regarding pulse counts from the threshold processing unit 407B, based on the fluctuation of pulse values over time, and then the unit 407C obtains the mean value of wave numbers per unit time. The processor 407 outputs the obtained maximum resistance and the mean value of wave numbers per unit time to a displaying device 408. In the present embodiment, the unit time for counting the above wave number is set at 0.328 second. The displaying device 408 is comprised of a display and others, and it displays the maximum resistance and the mean value of wave numbers per unit time obtained by the processor 407.

Next, a method of evaluating the electric resistance of the ball bearing 401 using the above configured apparatus will be explained.

Under the conditions where the shaft 402, that is, the inner ring 401*a* is being rotated at a certain rotational speed by the motor 403, a certain constant voltage is applied between the inner ring 401*a* and the outer ring 401*b* of the bearing 401 by the constant-voltage power supply 404. At this time, an electric current is passed between the inner ring 401*a* and the outer ring 401*b*, but the voltage is fluctuated by spark or the like. The voltage is measured by the resistance measuring apparatus 405, the measured value is then converted into a digital value by the A/D conversion circuit 406, and based on the digital signal, the maximum resistance and the wave number per certain unit time are obtained by the processor 407, and finally the obtained values are displayed on the displaying device 408.

The measurement conditions are as follows:

Inner ring rotational speed: 100 $min^{-1}$

Radial load (Fr) applied on bearing 401: 19.6 N

Voltage applied: 6.2 V

Maximum electric current: 100 μA

Series resistance: 62 kΩ

Atmosphere temperature: 40° C.

Atmosphere humidity: 50% RH

The results are shown in Tables 10 to 12. It should be noted that the bearing electric resistances described in Tables 10 to 12 are relative values in a case where the bearing electric resistance of Comparative example E1 is defined as 1.

The grease compositions in Examples E1 to E10 had good electric conductivity, but the grease composition in Comparative example E1 had poor electric conductivity because it did not contain carbon black.

Figure 17:
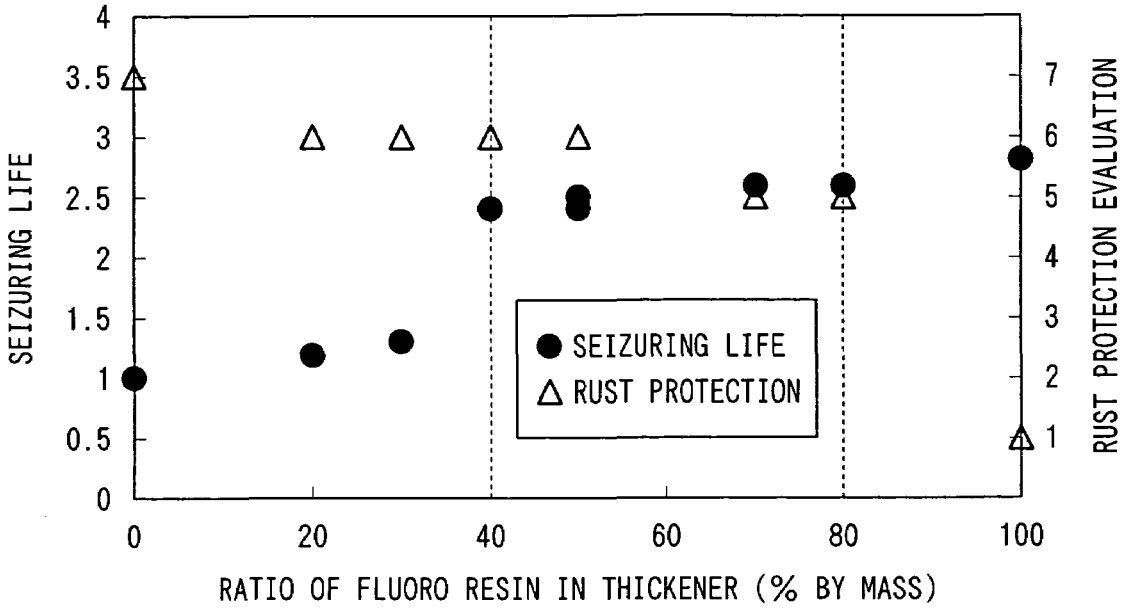
FIG. 17 is a graph showing the correlation between the ratio of a fluoro resin in a thickener, and the seizuring life of a ball bearing and the rust protection of a grease composition, in the case of using a grease composition comprising carbon black as the second thickener component.
Figure 18:
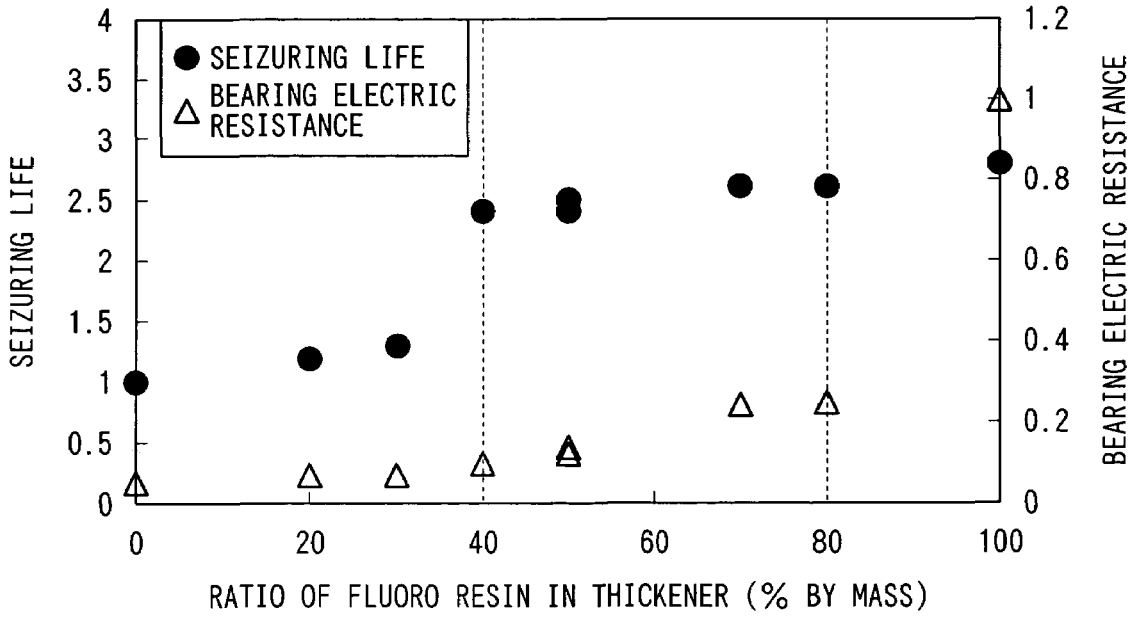
FIG. 18 is a graph showing the correlation between the ratio of a fluoro resin in a thickener, and the seizuring life and electric resistance value of a ball bearing, in the case of using a grease composition comprising carbon black as the second thickener component.

FIGS. 17 and 18 are graphs showing the results of the rust protection test, the seizure test and the electric conductivity test of the grease compositions of Examples E6 to E10 and Comparative examples E1, E2, E4 and E5. The horizontal axis of each graph represents the ratio of the fluoro resin (PTFE or a copolymer) in the thickener.

As is shown in these graphs, when the ratio of the fluoro resin in the thickener is 40 to 80% by mass (that is, the ratio of carbon black being 60 to 20% by mass), the grease composition is excellent in all of the rust protection, the seizuring life and the electric conductivity.

These embodiments are provided for illustrative purposes only, and are not intended to limit the scope of the invention.

For example, the types of the base oils, thickeners and additives used in the present grease composition are not limited to the above described ones.

Further, in the present embodiments, a deep groove ball bearing was used to explain the rolling apparatus of the present invention. However, the present invention can be applied to other various types of rolling bearings. Examples of such rolling bearings include radial rolling bearings such as an angular contact ball bearing, a self-aligning ball bearing, a cylindrical roller bearing, a tapered roller bearing, a needle roller bearing and a self-aligning roller bearing, and thrust rolling bearings such as a thrust ball bearing and a thrust roller bearing.

Moreover, the present invention is not limited to a rolling bearing, but can be applied to other various types of rolling apparatus. Examples of such rolling apparatuses include a ball screw, a linear guide apparatus, a linear bearing and others.

What is claimed is:

1. A grease composition comprising a base oil and a thickener, where said thickener comprises a flouro resin and a calcium sulfonate complex.

2. The grease composition according to claim 1, wherein said thickener comprises 5 to 95% by mass of the fluoro resin and 95 to 5% by mass of the calcium sulfonate complex.

3. The grease composition according to claim 2, wherein the content of said thickener is 10 to 40% by mass based on the total mass of the composition.

4. A rolling apparatus comprising an inner member having a raceway surface on the outer surface; an outer member which has a raceway surface opposed to the raceway surface of said inner member and is disposed outside of said inner member; and a plurality of rolling elements which are disposed between said two raceway surfaces so as to flexibly roll therebetween, wherein a space, which is formed between said inner member and said outer member and in which said rolling elements are disposed, is filled with the grease composition according to claim 1.

5. The rolling apparatus according to claim 4, which is a rolling bearing comprising the plurality of rolling elements disposed between an inner ring and an outer ring so that the rolling elements flexiblyl roll therebetween.

* * * * *